US006886870B2

(12) United States Patent
Ehrlich

(10) Patent No.: US 6,886,870 B2
(45) Date of Patent: May 3, 2005

(54) DOOR LOCK FOR A SEMI-TRAILER

(75) Inventor: Rodney P. Ehrlich, Monticello, IN (US)

(73) Assignee: Wabash National, L.P., Lafayette, IN (US)

( * ) Notice: Subject to any disclaimer, the term of this patent is extended or adjusted under 35 U.S.C. 154(b) by 0 days.

(21) Appl. No.: 09/982,289

(22) Filed: Oct. 17, 2001

(65) Prior Publication Data

US 2002/0056999 A1 May 16, 2002

Related U.S. Application Data

(60) Provisional application No. 60/248,868, filed on Nov. 15, 2000, and provisional application No. 60/299,247, filed on Jun. 19, 2001.

(51) Int. Cl.[7] ..... E05C 3/02
(52) U.S. Cl. ..... 292/240
(58) Field of Search ..... 292/11, 16, 29, 292/48, 52, 56, 240, 241, 285, 286, 284, DIG. 32; 220/1.5, 4.75

(56) References Cited

U.S. PATENT DOCUMENTS

| | | | | | |
|---|---|---|---|---|---|
| 724,110 | A | * | 10/1903 | Anderson | |
| 1,023,164 | A | * | 4/1912 | O'Connor | |
| 2,861,830 | A | * | 11/1958 | Bennett | 292/240 |
| 3,224,802 | A | * | 12/1965 | Pelcin | 292/246 |
| 3,451,700 | A | * | 6/1969 | Turpen | 292/218 |
| 3,596,403 | A | * | 8/1971 | Carr | 49/246 |
| 3,627,366 | A | * | 12/1971 | Cerutti | 292/188 |
| 4,082,330 | A | * | 4/1978 | McWhorter | 292/218 |
| 4,170,376 | A | * | 10/1979 | Banerjea | 292/218 |
| 4,422,313 | A | * | 12/1983 | VanderWyde | 70/167 |
| 4,660,872 | A | * | 4/1987 | Carson et al. | 292/242 |
| 4,690,442 | A | * | 9/1987 | Reynard | 292/218 |
| 4,768,816 | A | * | 9/1988 | Bakula | 292/218 |
| 4,895,007 | A | * | 1/1990 | Eberly | 70/54 |
| 5,154,458 | A | * | 10/1992 | Cook et al. | 292/218 |
| 5,718,467 | A | * | 2/1998 | Weinerman et al. | 292/218 |
| 5,934,116 | A | * | 8/1999 | Moore | 70/212 |
| 6,065,314 | A | * | 5/2000 | Nicholson | 70/212 |

* cited by examiner

*Primary Examiner*—Robert J. Sandy
*Assistant Examiner*—Andre' L. Jackson
(74) *Attorney, Agent, or Firm*—Trexler, Bushnell, Giangiorgi, Blackstone & Marr, Ltd.

(57) ABSTRACT

A door lock mechanism includes a sleeve mounted on the door of a trailer which extends a substantial dimension of the door. A lockrod is disposed in the sleeve and a handle assembly is connected to the bottom thereof. The handle assembly has structure and the top of the lockrod has structure which engage corresponding structures on the trailer, thereby locking the door in place. The handle assembly is used to rotate the lockrod, thereby selectively locking and unlocking the door. An end cap is disposed at each end of the sleeve, and the lockrod extends through an opening in the respective end caps. A thrust bearing is disposed between the end cap and the handle assembly and between the other end cap and the structure. The handle assembly includes a handle and structure that engages structure on the trailer, thereby locking the handle in place.

63 Claims, 17 Drawing Sheets

78
6
70
82
92
96
64
7
7
52
60
58
58
56
60
64
92
96
84
80
72
6

70
96
92
94
54
62
52
62
92
96
94
72

FIG.10
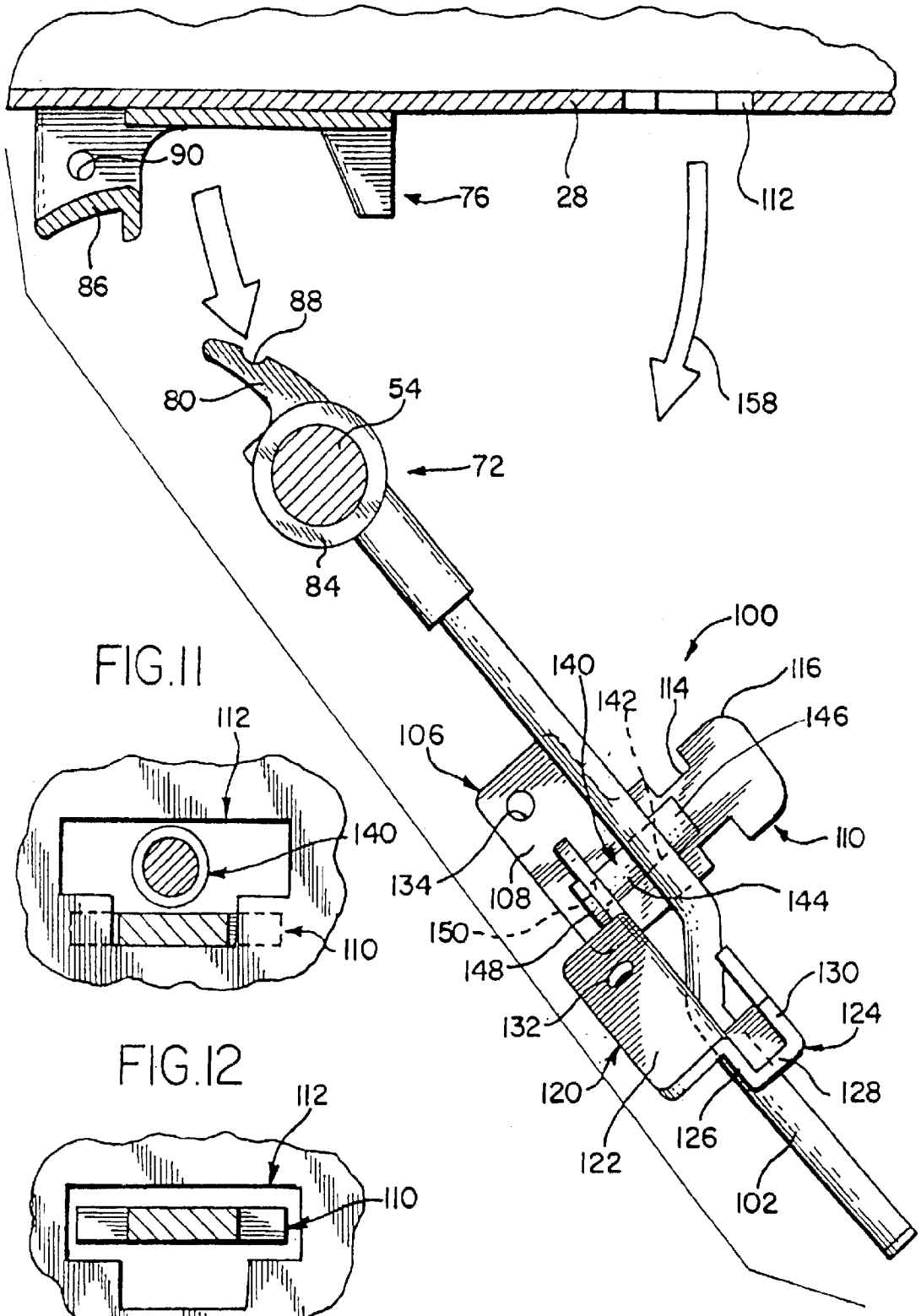
FIG.11
FIG.12
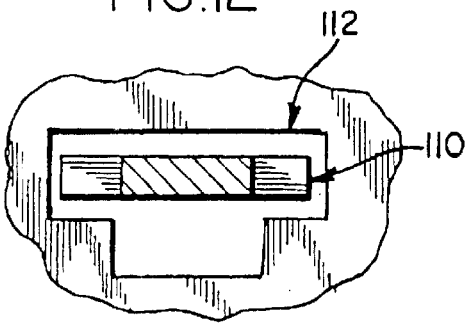

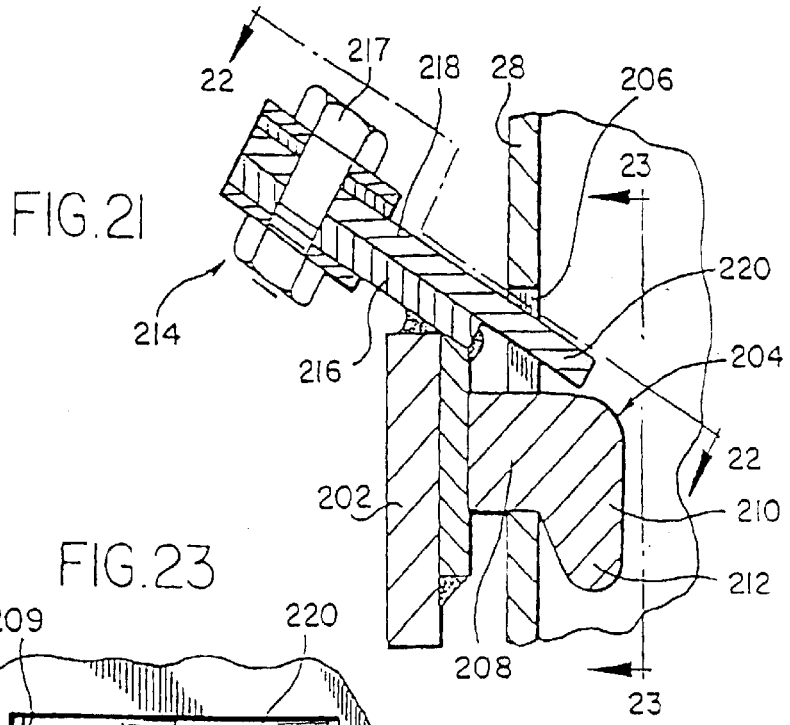
FIG.21
FIG.23
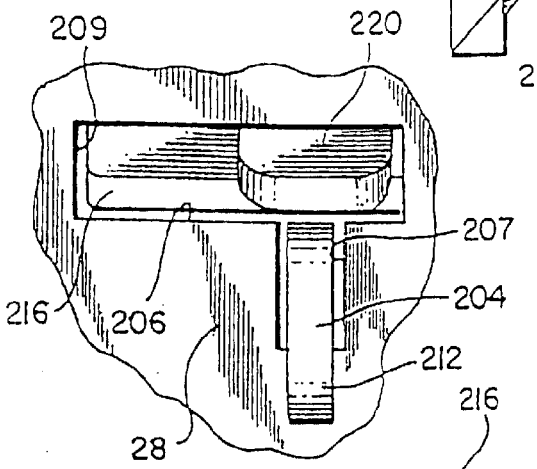
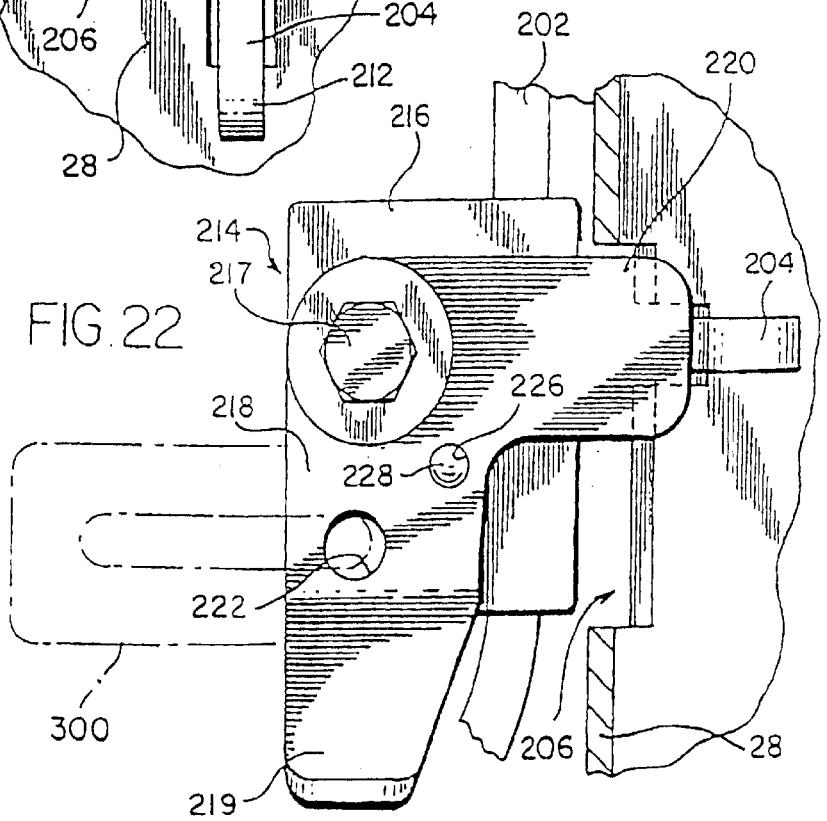
FIG.22

DOOR LOCK FOR A SEMI-TRAILER

This application claims the United States domestic priority of U.S. provisional application Ser. No. 60/248,868, filed Nov. 15, 2000 and entitled "Door Lock For A Semi-Trailer" and the United States domestic priority of U.S. provisional application Ser. No. 60/299,247, filed Jun. 19, 2001 and entitled "Door Lock For A Trailer"

BACKGROUND OF THE INVENTION

This invention is generally directed to a novel door lock mechanism for use with a semi-trailer.

A conventional tractor 10 and trailer 12 (also commonly referred to as a "semi-trailer") are illustrated in FIG. 1. Specifically, the trailer 12 is shown connected to the tractor 10. The trailer 12 includes a floor 14 with an undercarriage assembly 16 thereunder at its rearward end and an extendable and retractable landing gear assembly 18 thereunder positioned approximately half way between the front end of the trailer 12 and the trailer's longitudinal center of gravity. Opposite side walls 20 and a front wall 22 extend upwardly from the floor 14. A roof 24 is provided to close the top of the trailer 12. The roof 24 is secured to the side walls 20 by metal top rails 23, and the floor 14 is secured to the side walls 20 by metal base rails 25.

As illustrated in FIG. 2, a pair of rear doors 26 are provided at the rear end of the trailer 12 and are hingedly mounted to a rectangular rear frame 28 which has a rectangular opening therethrough into which the rear doors 26 fit when the rear doors 26 are moved to the closed position. The rear frame 28 includes a base portion 29 which is below the rear doors 26. FIG. 2 shows conventional door lock mechanisms 30 that are typically provided on the rear doors 26. Typically, the right door is referred to as the "curbside" door and the door lock mechanism associated therewith is referred to as the "curbside" lock. Likewise, typically the left door is referred to as the "roadside" door and the door lock mechanism associated therewith is referred to as the "roadside" lock.

Each door lock mechanism 30 includes an elongated, cylindrical lockrod 32 which extends along the height of the respective rear door 26. A generally U-shaped bearing plate 34 is provided proximate each end of the lockrod 32 and the bearing plates 34 are secured to the rear door 26 by fasteners 36. The lockrod 32 rotates within the bearing plates 34, and a handle 38 is provided for manipulating the position of the lockrod 32. As shown, the handle 38 is provided partway up the lockrod 32, on the respective door 26.

A cam 40 is integrally formed at each end of the lockrod 32. Each cam 40 is configured to engage corresponding keeper structure on the trailer, thereby locking the doors in the closed position. Specifically, the cams 40 at the bottom of the lockrods 32 engage lower door lockrod keepers 42, which are mounted on the rear frame 28, below the door opening. The cams 40 at the top of the lockrods 32 engage upper door lockrod keepers 44, which are mounted on the rear frame 28, above the door opening. Each keeper 42, 44 is attached to the rear frame 28 by suitable means, such as a weldment. As shown in FIG. 2, brackets 46 are typically provided on the doors 26 for engaging and securing the handles 38. Although not shown in FIG. 2, typically the brackets 46 are configured such that padlocks can be engaged with the brackets 46, thereby locking the handles 38 in place on the doors 26 (and thereby locking the doors 26 in the closed position).

As discussed above, door lock mechanisms 30 which are typically used in association with the rear doors 26 of a trailer 12 include bearing plates 34 which are secured to the doors 26, generally proximate each end of the lockrods 32. As shown in FIG. 2, the bearing plates 34 do not extend the entire height of each door 26. As such, the bearing plates 34 provide limited support for the lockrods 32.

As discussed above, door lock mechanisms 30 which are typically used in association with the rear doors 26 of a trailer 12 provide cams 40 at the top and bottom of the lockrods 32 which engage keepers 42, 44 on the trailer 12, and the brackets 46 are used to secure the handles 38. Typically, there is no other mechanism provided for locking the handles 38 in place other than the brackets 46 on the doors 26. Door lock mechanisms 30 which are typically used in association with the rear doors 26 of a trailer 12 also do not provide that the doors 26 can be secured in an open position. Additionally, because the handles 38 are provided partway up the doors 26, when the doors 26 are swung to the open position, the handles 38 may bear against the side walls 20 of the trailer 12, possibly causing damage.

The present invention provides a novel locking mechanism which overcomes the disadvantages presented by the prior art. Other features and advantages will become apparent upon a reading of the attached specification, in combination with a study of the drawings.

OBJECTS AND SUMMARY OF THE INVENTION

It is a general object of the present invention to provide a novel door lock mechanism configured for use with a trailer.

It is an object of the present invention to provide a door lock mechanism configured for use with a trailer, where the door lock mechanism includes a sleeve which extends at least a substantial dimension, such as the entire height, of a door of the trailer.

Another object of the present invention is to provide a door lock mechanism configured for use with a trailer, where the door lock mechanism includes a handle assembly that includes a tongue which is configured to engage corresponding structure on the trailer, thereby generally locking a handle of the handle assembly in place.

Still another object of the present invention is to provide a door lock mechanism configured for use with a trailer, wherein the door lock mechanism includes an end cap that is disposed generally at an end of a sleeve, includes a lockrod which extends through an opening in the end cap, and includes a thrust bearing which is disposed between the end cap and the handle assembly.

Yet another object of the present invention is to provide a door lock mechanism configured for use with a trailer, where the door lock mechanism is configured to provide that a door of the trailer can be secured in an open position.

Another object of the present invention is to provide a door lock mechanism configured for use with a trailer in which the door lock mechanism includes a tongue portion that is moved into engagement with a corresponding opening on the trailer primarily by the force of gravity.

Yet another object of the present invention is to provide a door lock mechanism configured for use with a trailer, which includes a dog which is configured to engage the corresponding opening on the trailer, thereby generally locking a handle assembly in place.

Yet a further object of the present invention is to provide a door lock mechanism configured for use with a trailer, which includes a structure on the handle assembly that includes a tongue portion configured to engage the same corresponding opening on the trailer as the dog engages such that the tongue portion holds the dog in engagement with the opening, thereby further locking the handle assembly in place.

Still another object of the present invention is to provide a door lock mechanism configured for use with a trailer, where the door lock mechanism includes a handle assembly which is provided below the doors such that when the doors are swung to the open position, the handle assembly will not bear against the side walls.

Briefly, and in accordance with one or more of the foregoing objects, an embodiment of the present invention provides a door lock mechanism configured for use with a trailer.

The door lock mechanism includes a sleeve mounted on the door of the trailer. Preferably, the sleeve extends at least a substantial dimension, such as the entire height, of the door. A lockrod is disposed in the sleeve. A handle assembly is connected to the end of the lockrod, and the handle assembly has structure thereon which is configured to engage corresponding structure on the trailer, thereby generally locking the door in place. Additionally, the top of the lockrod has structure thereon which is configured to engage corresponding structure on the trailer, thereby generally locking the door in place. The handle assembly is configured for actuation to rotate the lockrod, thereby selectively locking and unlocking the door. An end cap is disposed generally at an end of the sleeve, and the lockrod extends through an opening in the end cap. A thrust bearing is disposed between the end cap and the handle assembly.

In a first embodiment, the handle assembly includes a handle and a tongue that is configured to engage corresponding structure on the trailer, thereby generally locking the handle in place. The handle assembly also includes a lever which is disposed on the handle. The lever includes a pin that extends through an aperture in the handle, and the lever is configured such that the lever can be manipulated relative to the handle to provide that the pin is disposed generally over the tongue, thereby generally further locking the handle in place.

In a second embodiment, the handle assembly includes a handle which has a dog thereon that is configured to engage a corresponding opening on the trailer, thereby locking the handle in place and further locking the door in place. The handle assembly also includes a structure which is disposed on the handle. The structure is inclined relative to the handle and includes an L-shaped member having a gripping portion and a tongue portion that is configured such that the L-shaped member can be manipulated to provide that the tongue portion is disposed generally over the dog, thereby further locking the handle in place. Because of the inclination of the structure relative to the handle, the L-shaped member is moved into engagement with the dog and the opening primarily by the force of gravity. The L-shaped member also includes an aperture therein configured such that when the L-shaped member is in engagement with the corresponding opening on the trailer, a pin, or other locking means, can be inserted through the aperture thereby locking the L-shaped member in engagement with the corresponding opening.

BRIEF DESCRIPTION OF THE DRAWINGS

The organization and manner of the structure and function of the invention, together with further objects and advantages thereof, may be understood by reference to the following description taken in connection with the accompanying drawings, wherein:

FIG. 10 is a view similar to FIG. 7, but showing a handle assembly of the door lock mechanism of FIG. 3 being disengaged from corresponding structure on the trailer;

FIG. 11 is a cross-sectional view of the right-hand side (i.e. curbside) door lock mechanism shown in FIG. 3, taken along line 11—11 of FIG. 8;

FIG. 12 is a cross-sectional view similar to FIG. 11, but showing a pin withdrawn and a tongue lifted in a slot;

FIG. 21 is a cross-sectional view of the structure on the right-hand side (i.e., curbside) door lock mechanism shown in FIG. 19, taken along line 21—21 of FIG. 19;

FIG. 22 is a cross-sectional view of the structure on the right-hand side (i.e., curbside) door lock mechanism shown in FIG. 19, taken along line 22—22 of FIG. 21;

FIG. 23 is a cross-sectional view of the structure on the right-hand side (i.e., curbside) door lock mechanism shown in FIG. 19, taken along line 23—23 of FIG. 21;

DETAILED DESCRIPTION OF THE ILLUSTRATED EMBODIMENT

Figure 1:
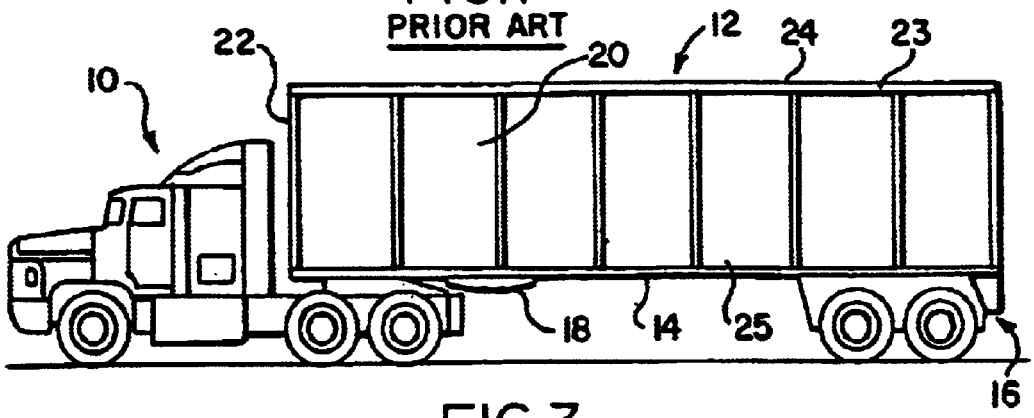
FIG.1 PRIOR ART
FIG. 1 is a side elevational view of a prior art tractor and trailer, showing the trailer connected to the tractor.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

FIGS. 3–18 illustrate novel door lock mechanisms 50 which incorporates features of a first embodiment of the invention. FIGS. 19–33 illustrate novel door lock mechanisms 50' which incorporates features of a second embodiment of the invention. The door lock mechanisms 50, 50' of the present invention are provided on a conventional trailer 12 as described in the prior art replace the door lock mechanisms described in the prior art. Therefore, the specifics of the trailer 12 are not described. The components of the first embodiment of the door lock mechanism 50 will first be described, and thereafter the components of the second embodiment of the door lock mechanism 50' will be described. Components in the second embodiment of the door lock mechanism 50' which are identical to components in the first embodiment of the door lock mechanism 50 are denoted with a prime after the number.

Attention is invited to the first embodiment of the novel door lock mechanisms 50 shown in FIGS. 3–18. The door lock mechanisms 50 are provided on the rear doors 26. One door lock mechanism 50 is provided for locking the right, or "curbside", door, and a similar door lock mechanism 50 is provided for locking the left, or "roadside", door. The left-side (i.e. roadside) door lock mechanism is very similar to the right-side (i.e. curbside) door lock mechanism. In fact, many components of the left-side door lock mechanism are identical to those of the right-side door lock mechanism, and other components of the left-side door lock mechanism effectively mirror corresponding components of the right-side door lock mechanism. For clarity, the right-side door lock mechanism is primarily shown in the drawings and described hereinbelow.

Figure 3:
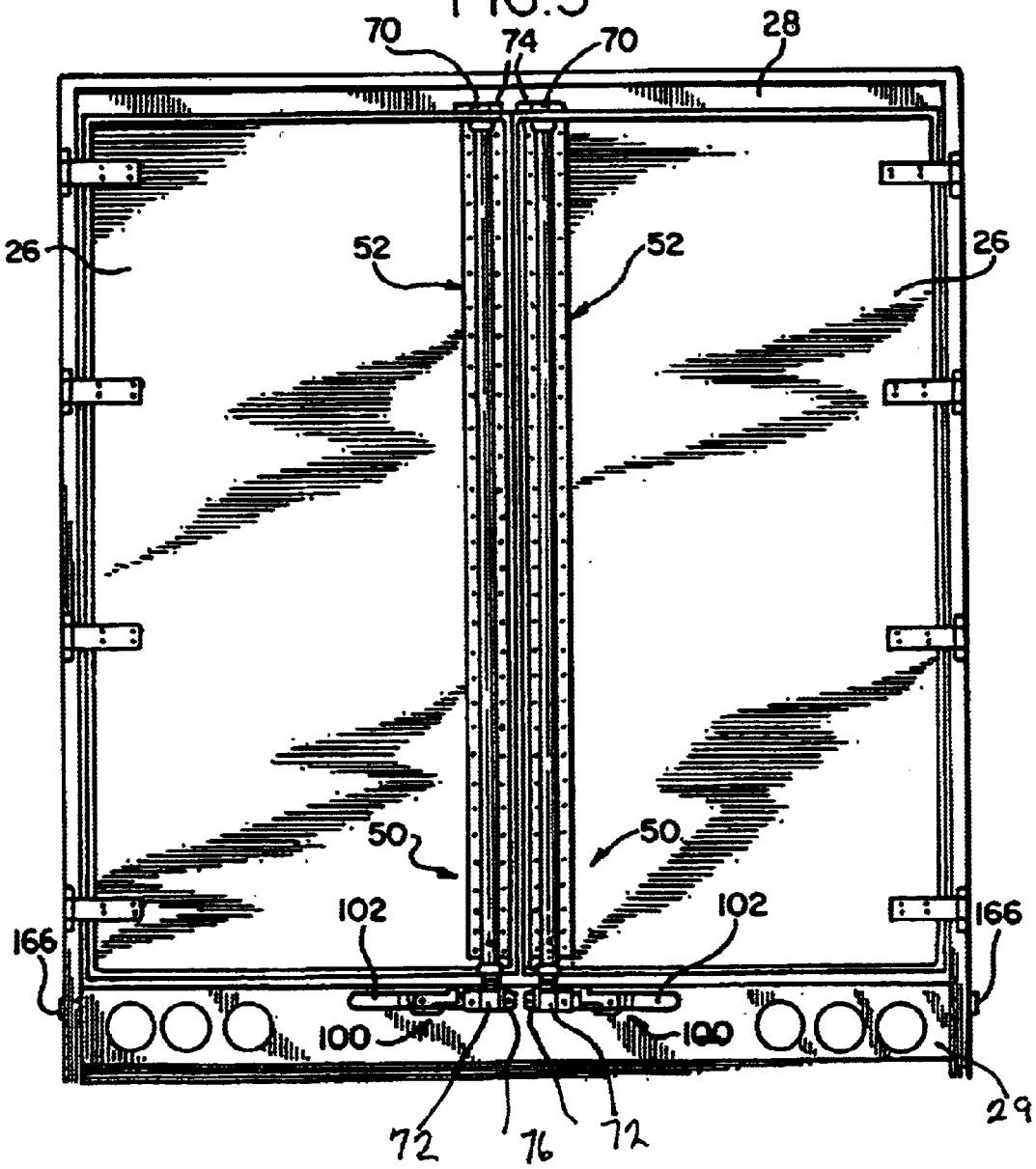
FIG. 3 is a rear elevational view of a trailer, showing door lock mechanisms which incorporate features a first embodiment of the invention.
Figure 2:
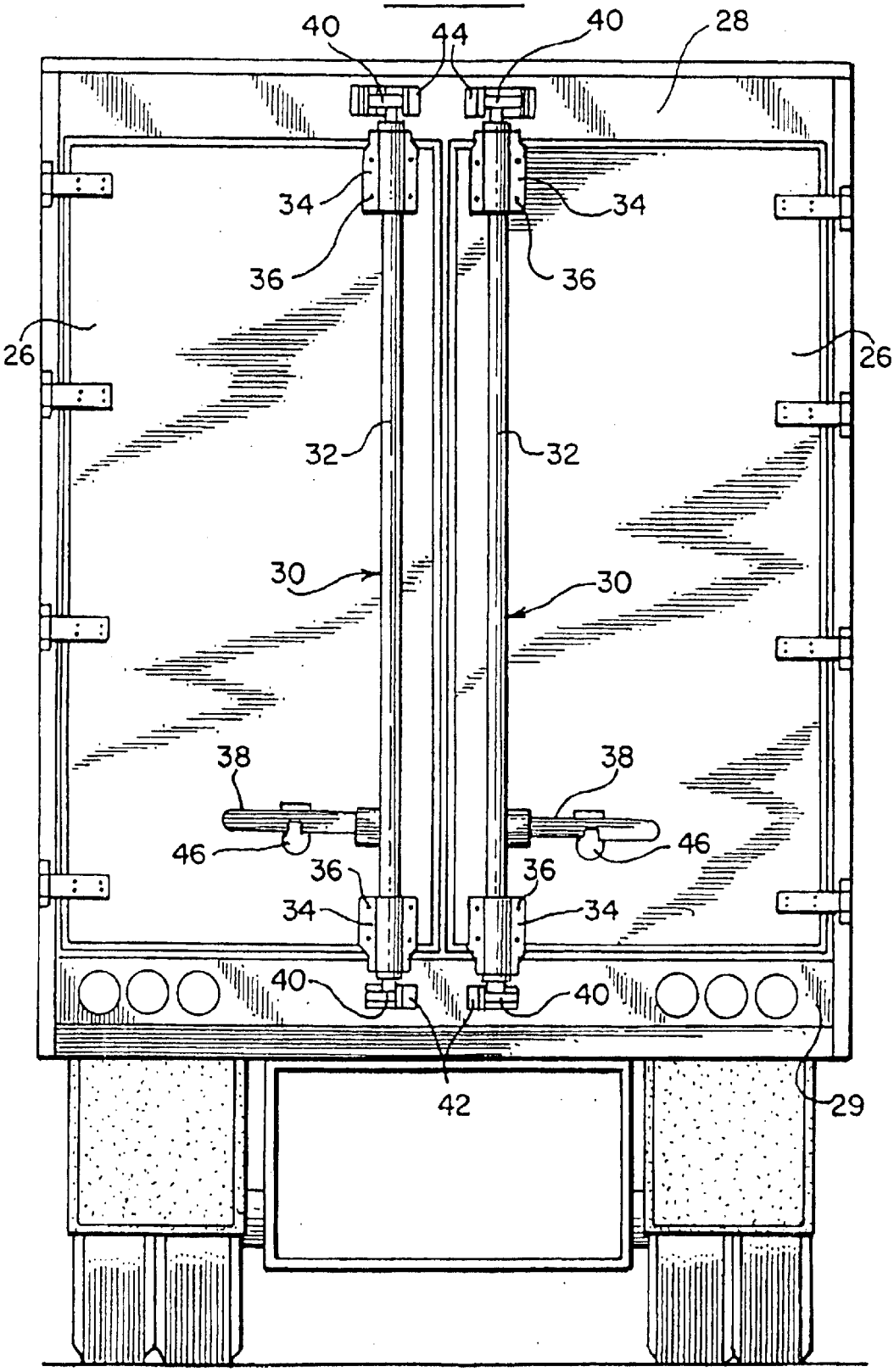
FIG. 2 PRIOR ART
FIG. 2 is a rear elevational view of the prior art trailer shown in FIG. 1, showing prior art door lock mechanisms associated with rear doors of the trailer.

As shown in FIG. 3, each door lock mechanism 50 includes a continuous sleeve 52 or lockrod cover which preferably extends a substantial dimension of the respective door 26. As shown, each sleeve 52 effectively extends the entire height of the door 26. As such, each sleeve 52 provides enhanced support for a lockrod 54 which is disposed therein, see FIG. 6. The lockrod 54 will be described more fully later herein.

Each sleeve 52 provides a U-shaped channel 56 and a pair of rails 58 which are secured to the respective door 26. As such, each sleeve 52 is generally "hat" shaped. Specifically, the rails 58 receive fasteners 60 which are secured to the trailer door 26, thereby securing the sleeve 52 to the door 26. Preferably, the sleeve 52 is made by an extrusion process, and is preferably formed of aluminum.

Figure 5:
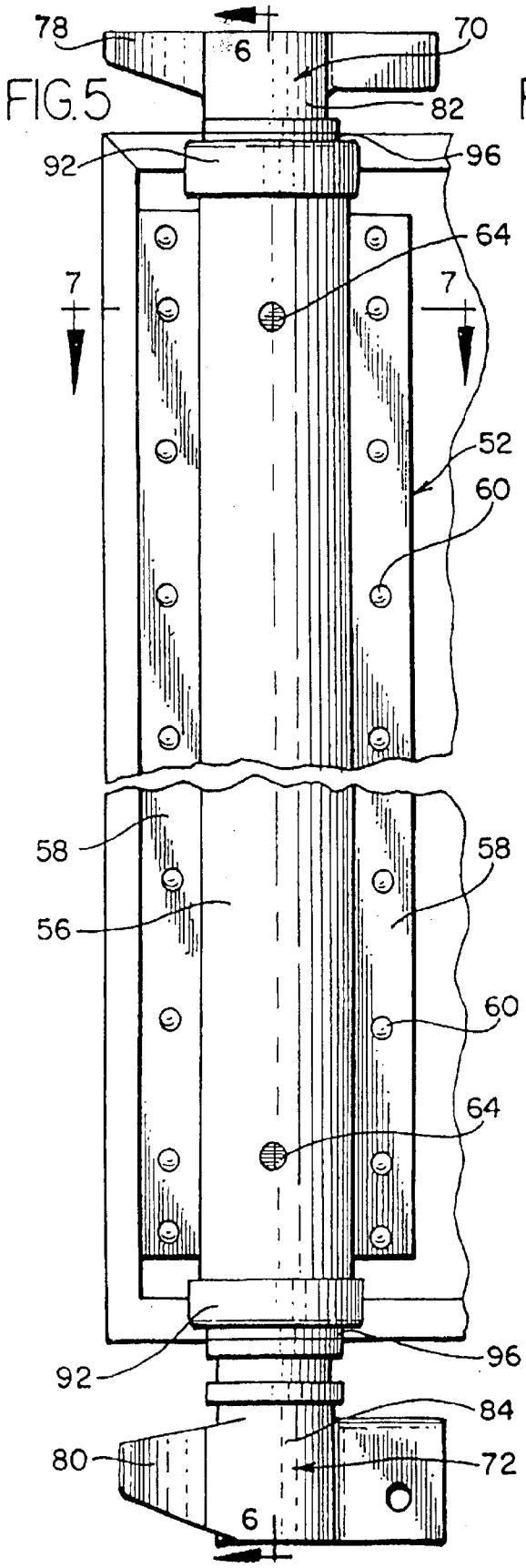
FIG. 5 is a plan, broken view of the right-hand side (i.e. curbside) door lock mechanism shown in FIG. 3, wherein a handle is omitted for clarity.
Figure 6:
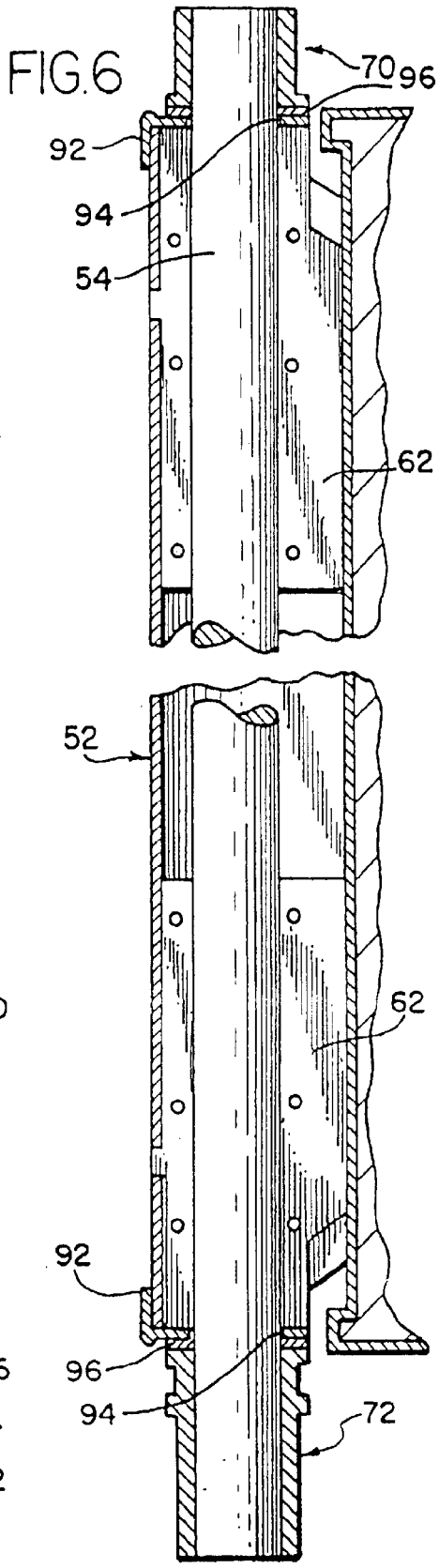
FIG. 6 is a cross-sectional view of the right-hand side (i.e. curbside) door lock mechanism shown in FIG. 3, taken along line 6—6 of FIG. 5.

As shown in FIG. 6, a lockrod 54 is disposed in the sleeve 52, and the lockrod 54 is preferably a solid cylindrical rod. The lockrod 54 is disposed in the sleeve 52 such that the lockrod 54 can rotate in the sleeve 52. The lockrod 54 is preferably formed of steel, but may be formed of some other suitable material. Sleeve bearings 62 are preferably disposed in the sleeve 52 and the lockrod 54 extends through the sleeve bearings 62. As shown, one sleeve bearing may be disposed proximate the top of the lockrod 54, and another may be disposed proximate the bottom of the lockrod 54. Each sleeve bearing 62 may comprise two halves which mate to form a generally cylindrical channel through which the lockrod 54 extends. As shown in FIGS. 3 and 5, each sleeve bearing 62 is secured to the sleeve 52 by a knot 64 which extends outwardly from the body of the bearing and engages an aperture in the channel, such that rotation between the bearing and the sleeve is prevented. The sleeve bearings 62 provide axial support for the lockrod 54.

Figure 4:
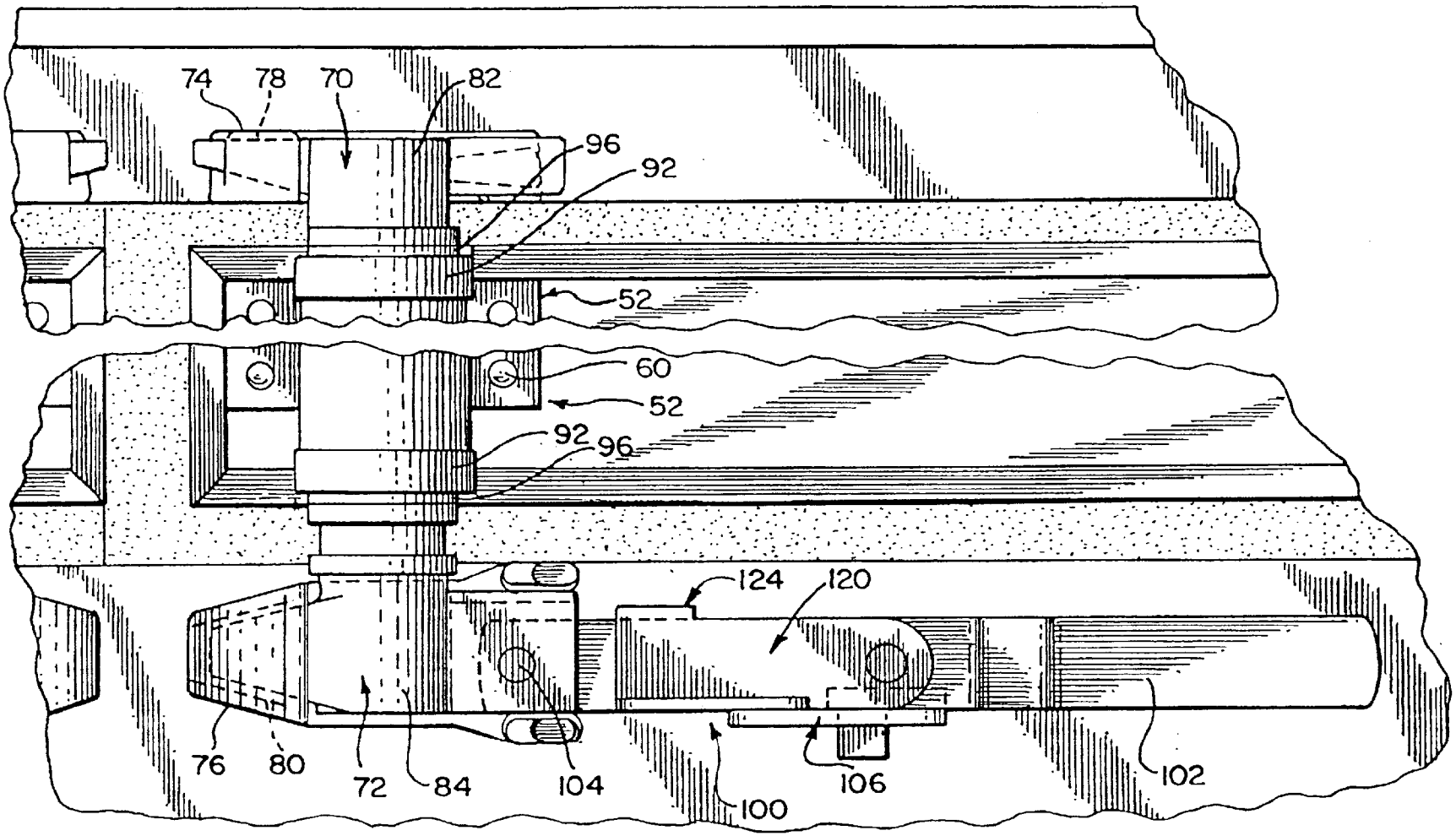
FIG. 4 is a plan, broken view of the right-hand side (i.e. curbside) door lock mechanism shown in FIG. 3, showing top and bottom portions of the door lock mechanism engaged with corresponding structure on the trailer.

A cam 70, 72 is secured to each end of the lockrod 54, see FIGS. 4–6. The cams 70, 72 may be secured to the ends of the lockrod 54 via a weldment, rivets or some other suitable means. The cams 70, 72 are configured to engage corresponding keepers 74, 76 which are secured to the rear frame 28 of the trailer 12, above and below each door 26, thereby effectively locking the respective door 26 in the closed position. Each keeper 74, 76 is secured to the trailer 12 by rivets, a weldment, or some other suitable means.

Figure 7:
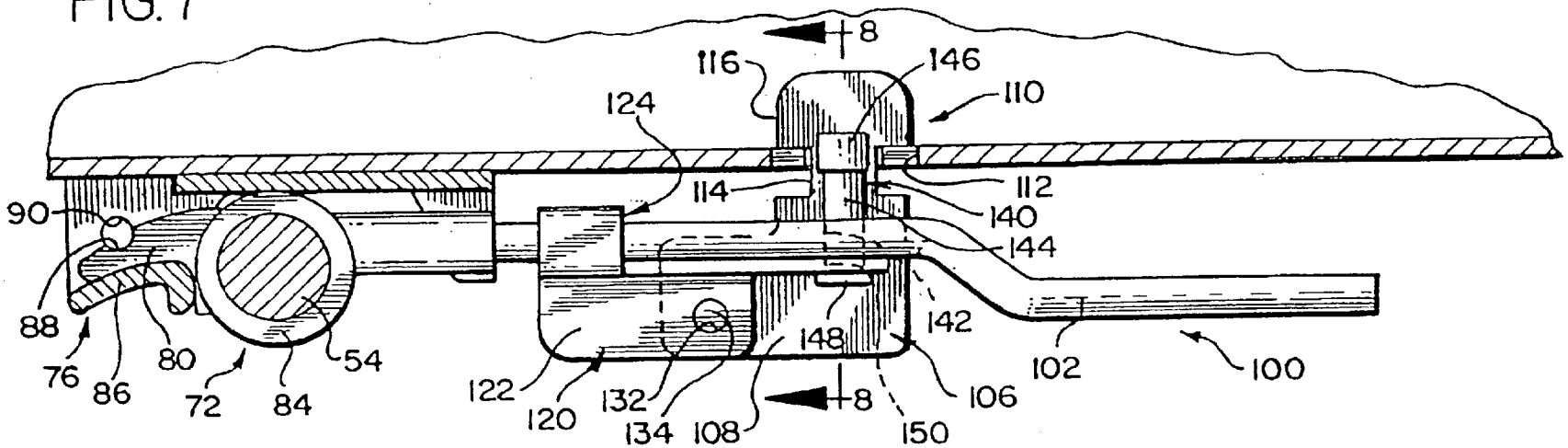
FIG. 7 is a cross-sectional view of the right-hand side (i.e. curbside) door lock mechanism shown in FIG. 3, taken along line 7—7 of FIG. 5.

As shown in FIGS. 4, 5, 7, 10 and 13–16, each cam 70, 72 includes an extending portion 78, 80 or toe which extends from a main body portion 82, 84. FIGS. 7 and 10 illustrate the keeper 76 which is secured to the trailer 12 below the right-hand side (i.e. curbside) door 26. The other keepers, i.e. the keeper 74 above the right-hand side (i.e. curbside) door, and the keepers 74, 76 above and below the left-hand side (i.e. roadside) door are similar. As shown in FIG. 7, the extending portion 80 of cam 72 is configured to engage a corresponding retaining wall 86 provided in the keeper 76, thereby effectively locking the cam 72 in place. While FIG. 7 illustrates the lower cam 70 on the right-hand side, or curbside, door lock mechanism 50, engaging the keeper 72, engagement of the other cams (i.e. the upper cam on the curbside door lock mechanism and the cams on the roadside door lock mechanism) with their corresponding keepers is much the same.

As shown in FIGS. 7 and 10, the extending portion 80 of each lower cam 72 may include a cut out 88 which mates with a corresponding aperture 90 in the keeper 76. A pin (not shown) or some other retaining member may be inserted in the cut out 88 and aperture 90 when the cam 72 is in the position shown in FIG. 7, thereby securing the cam 72 in the keeper 76.

As shown in FIGS. 4–6, a stainless steel end cap 92 is provided on each end of the sleeve 52, and the lockrod 54 extends through apertures 94 in the end caps 92. The end caps 92 are secured to the ends of the sleeve 52 by suitable means, such as a friction fit or a weldment.

A thrust bearing 96, such as a ring formed of high density polyethylene, is disposed between each end cap 92 and cam 70, 72 and encircles the lockrod 54. The thrust bearings 96 provide support when the lockrod 54 is rotated in the sleeve 52, allow for ease of rotation between the end cap 92 and the cam 72, provides for smooth rotation between the end cap 92 and the cam 72, and tightens up the door hardware. The thrust bearing is split and can be replaced easily when it becomes worn.

As shown in FIGS. 3, 4, 7, 10 and 13–17, the lower cam 72 is a component of a handle assembly 100. The handle assembly 100 can be engaged with a T-shaped slot 112 provided in the metal base portion 29 in the trailer 12 to lock the door 26 in the closed position. In addition, the handle assembly 100 can be engaged with a T-shaped slot 162 provided in the metal base rail 25 on the side of the trailer 12 to lock the door 26 in the open position. The novel handle assembly 100 is provided below the doors 26 such that when the doors 26 are swung to the open position, the handle assembly 100 will not bear against the side walls 20 and will instead bear against the metal base rail 25.

Specifically, a handle 102 is attached to the lower cam 72. Preferably, the handle 102 is attached to the lower cam 72 via a pin 104 or some other means which allows the handle 102 to pivot relative to the cam 72 (compare FIG. 15 to FIG. 16). The handle 102 is preferably formed of steel or some other suitable material. As will be described more fully later herein, the handle assembly 100 is configured such that the handle 102 can be manipulated to lock and unlock the door 26.

As shown in FIGS. 7–10 and 13–16, the handle assembly 100 includes a latch 106 which is secured to the handle 102. The latch 106 may be secured to the handle 102 via one or more rivets, a weldment or some other suitable means.

As shown, the latch 106 includes a main portion 108 and a T-shaped tongue 110 which extends from the main portion 108, generally perpendicular to the handle 102. As shown in FIGS. 7–9, 11 and 12, the T-shaped tongue 110 is configured to be received in a corresponding T-shaped slot 112 in the trailer 12, thereby generally securing the handle 102 in place. Specifically, the T-shaped tongue 10 includes a narrow portion 114 proximate to the latch 106 and a wide portion 116 at the end of the narrow portion 114. Providing that the T-shaped tongue 110 engages a T-shaped slot 112 and that the T-shaped tongue 110 includes a wide portion 116 allows for withdrawing the T-shaped tongue 110 from the T-shaped slot 112 only when the T-shaped tongue 110 is positioned in the upper, or wider, part of the T-shaped slot 112. In other words, the T-shaped tongue 110 cannot be withdrawn from the T-shaped slot 112 when the T-shaped tongue 110 is in the position shown in FIG. 11, but can be withdrawn when in the position shown in FIG. 12.

As shown in, for example, FIGS. 7, 10 and 13–16, a lever 120 is also engaged with the handle 102. The lever 120 preferably includes a base portion 122 and a hook portion 124 which extends from the base portion 122. As shown in FIG. 10, the base portion 122 is a generally flat surface, and the hook portion 124 comprises a first wall 126 which extends generally perpendicular from the base portion 122, a second wall 128 which extends generally perpendicular to the first wall 126 and which is generally parallel to the base portion 122, and a third wall 130 which extends generally perpendicular to the second wall 128 and which is generally parallel to the first wall 126.

Figure 8:
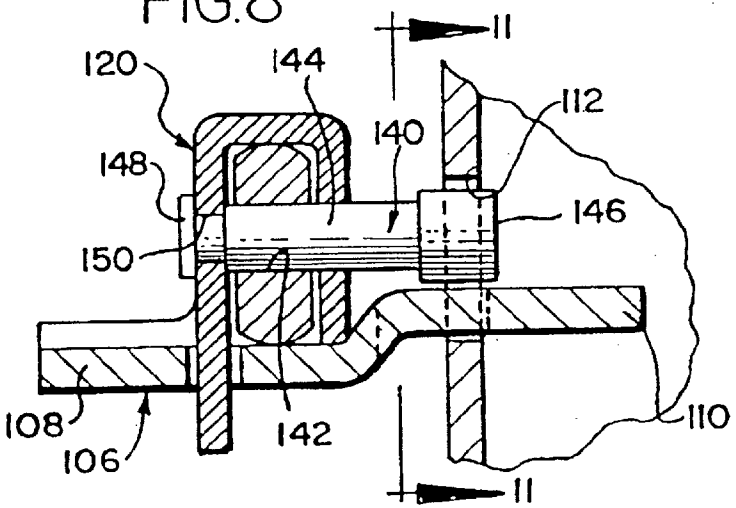
FIG. 8 is a cross-sectional view of the right-hand side (i.e. curbside) door lock mechanism shown in FIG. 3, taken along line 8—8 of FIG. 7.
Figure 13:
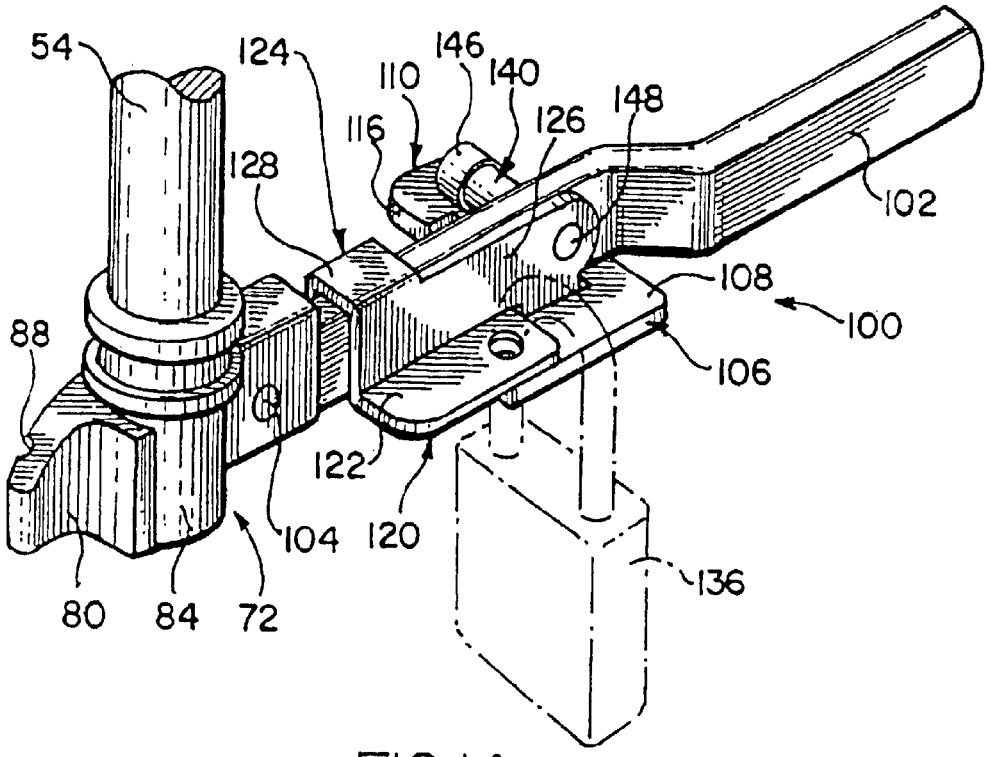
FIG. 13 is a left, perspective view of a lower portion of the right-hand side (i.e. curbside) door lock mechanism shown in FIG. 3, showing a padlock engaged with a handle assembly and showing a pin in an extended position thereby locking a handle in place.

FIGS. 7, 8 and 13 illustrate the lever 120 in the closed position. As shown, when the lever 120 is in the closed position, the hook portion 124 of the lever 120 receives the handle 102. As shown in FIG. 13, when the lever 120 is in the closed position, an aperture 132 in the base portion 122 of the lever 120 aligns with a corresponding aperture 134 in the main portion 108 of the latch 106 (see also FIGS. 10 and 14–16 which illustrate the aperture 134 in the main portion 108 of the latch 106). As shown in FIG. 13, this provides that a padlock 136 can be used to effectively lock the latch 106 and the lever 120 together.

Figure 9:
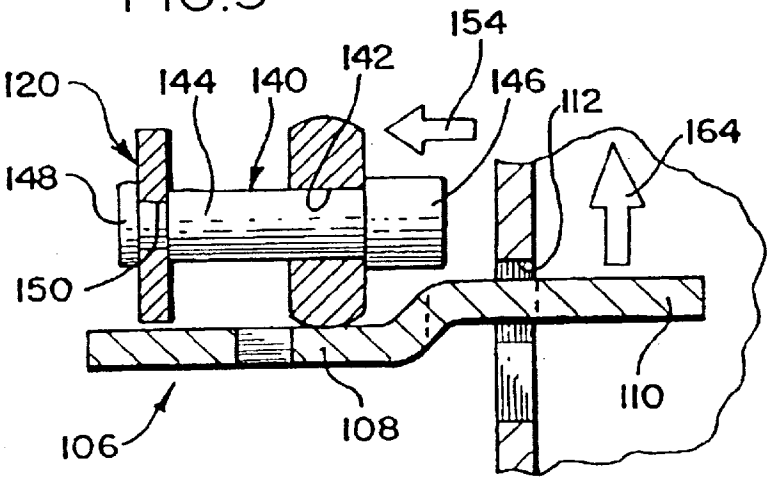
FIG. 9 is a view similar to FIG. 8, but showing a pin withdrawn and a handle lifted, thereby effectively releasing the handle.

A pin 140 is engaged with the lever 120, and the pin 140 extends through an aperture 142 in the handle 102. As shown in FIG. 8, the pin 140 preferably includes a main shaft portion 144, a head portion 146 and an end portion 148. As shown, the pin 140 preferably extends through an aperture 150 in the lever 120 and the lever 120 is disposed between the end portion 148 and the main shaft portion 144 of the pin 140. Preferably, the diameter of the end portion 148 is larger than the diameter of the aperture 150 in the lever 120 through which the pin 140 extends, thereby providing that the pin 140 is generally axially retained on the lever 120. Likewise, as shown in FIG. 9, preferably the head portion 146 of the pin 140 has a larger diameter than does the aperture 142 in the handle 102 through which the pin 140 extends, thereby providing that the pin 140 cannot be fully withdrawn from the aperture 142 in the handle 102. Although not specifically shown, a biasing member, such as a coil spring, can be provided on the main shaft portion 144 of the pin 140, generally between the handle 102 and the lever 120, thereby providing that the lever 120 is biased into the pulled out position.

Figure 14:
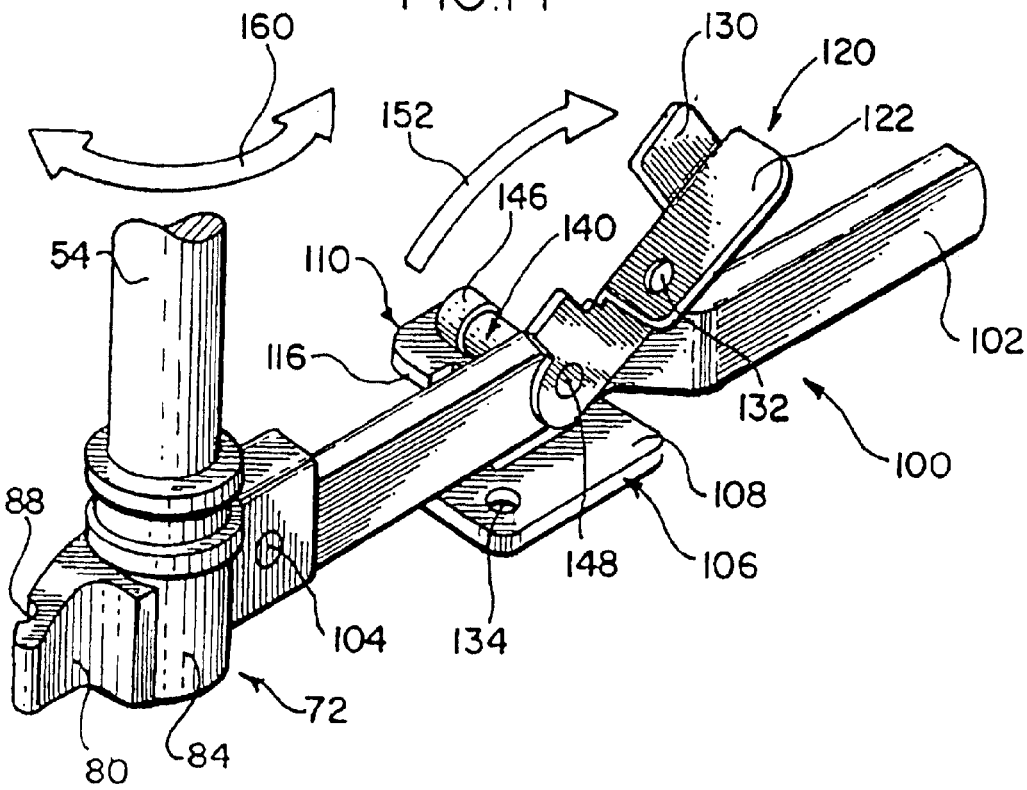
FIG. 14 is a view similar to FIG. 13, but showing a lever rotated relative to the handle.
Figure 15:
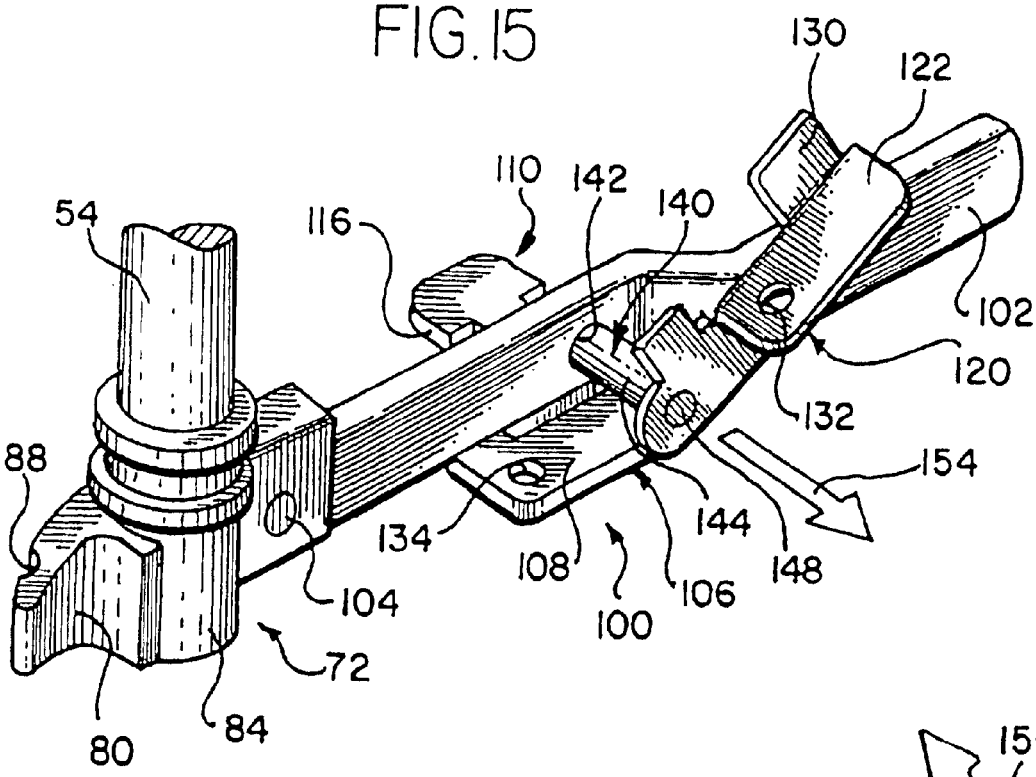
FIG. 15 is a view similar to FIG. 14, but showing the lever pulled thereby causing a pin of the lever to withdraw from a slot.
Figure 16:
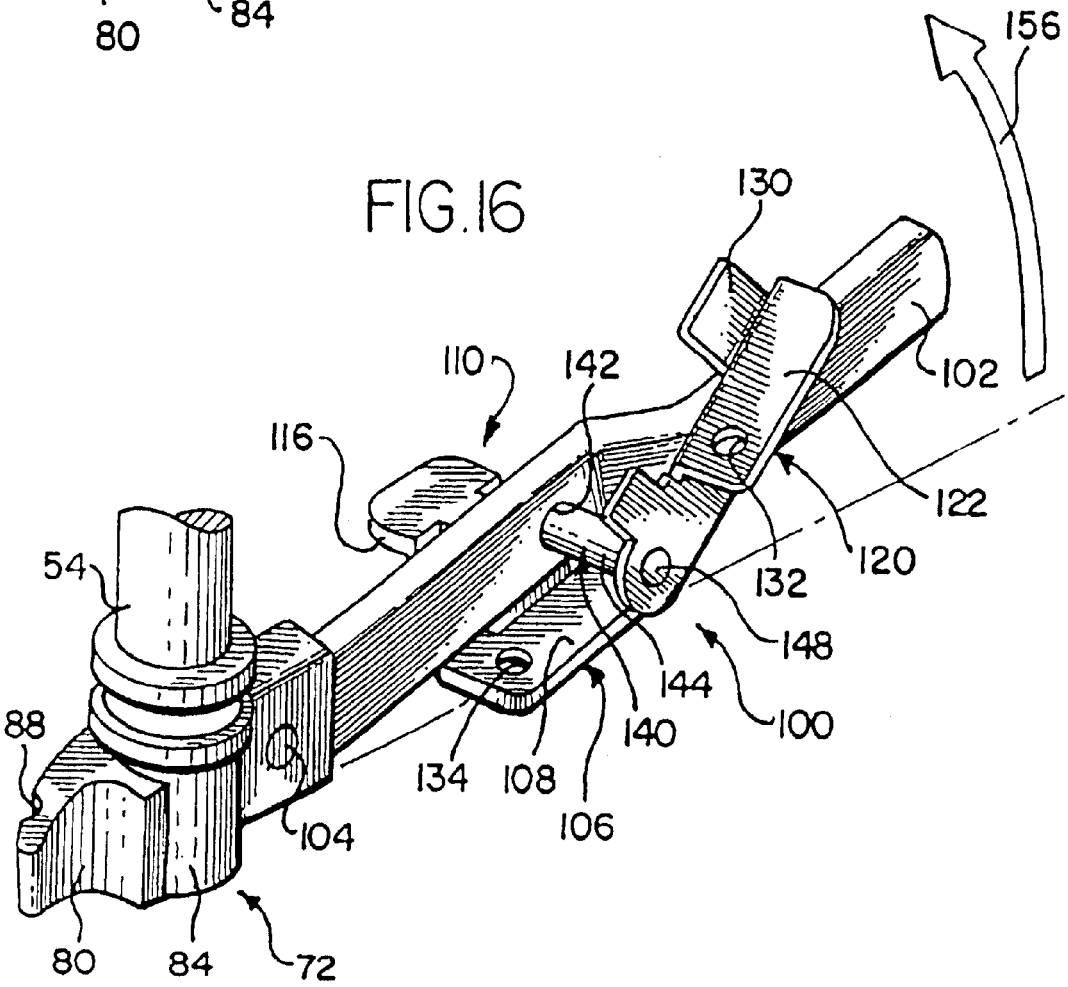
FIG. 16 is a view similar to FIG. 15, but showing the handle being lifted.

As shown in the progression from FIG. 13 to FIG. 14, the pin 140 provides that the lever 120 can be rotated (represented by arrow 152 in FIG. 14) about a longitudinal axis of the pin 140, between a closed position, illustrated in FIG. 13, and an open position, illustrated in FIG. 14. Additionally, as shown in the progression from FIG. 14 to FIG. 15, the pin 140 is slidable in the aperture 142 in the handle 102, thereby providing that the lever 120 can be pulled out (represented by arrow 154 in FIGS. 9 and 15), generally along the longitudinal axis of the pin 140. When the lever 120 is not pulled out, as illustrated in FIG. 14, the pin 140 is disposed generally above the T-shaped tongue 110, see FIG. 11. As a result, the T-shaped tongue 110 cannot readily be lifted in the T-shaped slot 112, see FIG. 12, such as by lifting up on the handle 102 as shown in FIG. 16 (and represented by arrow 156), and withdrawn from the T-shaped slot 112 as shown in FIG. 10 (and represented by arrow 158). In contrast, when the lever 120 is pulled out, as illustrated in FIG. 15, the pin 140 is withdrawn from above the T-shaped tongue 110. When the pin 140 is withdrawn from above the T-shaped tongue 110, the handle 102 can be lifted as shown in FIG. 16, to provide that the T-shaped tongue 110 moves up in the T-shaped slot 112, as shown in FIG. 12. Subsequently, the handle 102 can be rotated to withdraw the T-shaped tongue 110 from the T-shaped slot 112, as shown in FIG. 10. As the handle 102 is rotated, the cams 70, 72 and lockrod 54 also rotate (as represented by arrow 160 in FIG. 14), causing the upper and lower cams 70, 72 to disengage from their respective keepers 74, 76. Then, the door 26 can be swung open.

Figure 17:
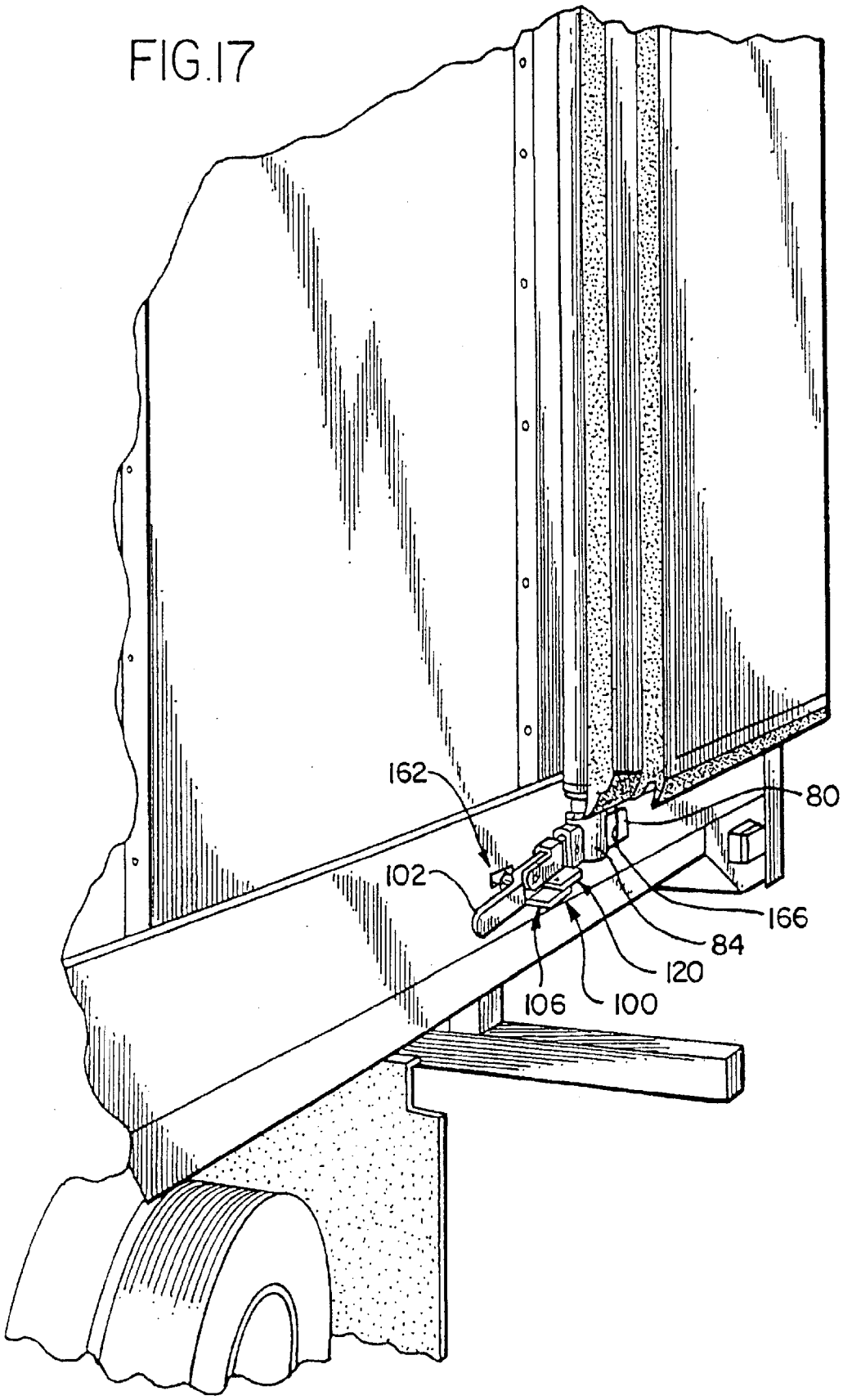
FIG. 17 is a left, perspective view of the trailer, showing the left door (i.e. the roadside door) in an open position, and showing the left-side (i.e. roadside) door lock mechanism of FIG. 3 engaged with corresponding structure on the trailer, thereby locking the door in the open position.

Preferably, T-shaped slots 162 much like the T-shaped slots 112 provided on the rear of the trailer 12, are provided on the lower rail 25 on each side of the trailer 12. FIG. 17 illustrates such a T-shaped slot 162 provided on the left side, or roadside side, of the trailer 12. As shown, providing such a T-shaped slot 162 on the lower rail of the side of the trailer 12 provides that the pin 140 and T-shaped tongue 110 can be engaged with the T-shaped slot 162 to effectively retain the door 26 in the open position much like how the door 26 is retainable in the closed position by engaging the pin 140 and T-shaped tongue 110 with the T-shaped slot 112 on the rear of the trailer 12. Of course, a padlock 136 can be engaged with the latch 106 and lever 120 like shown in FIG. 13 to lock the door 26 in the open position, if desired.

Figure 18:
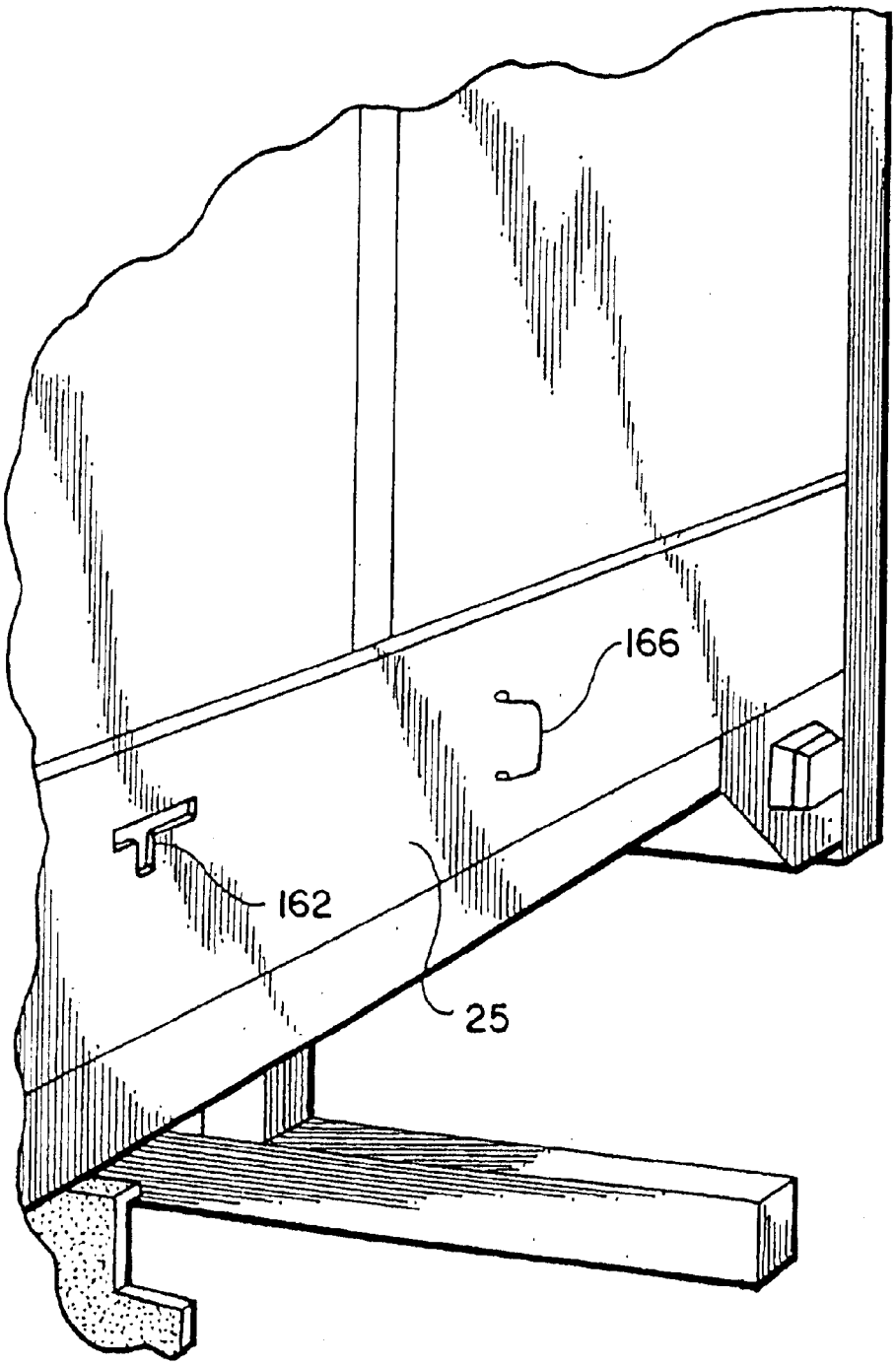
FIG. 18 is a left, perspective view of the trailer, with the left door (i.e. the roadside door) in a closed position.

In addition, a wicket 166 is provided on the lower rail 25 on each side of the trailer 12 as best illustrated in FIG. 18. The wicket 166 is formed from a suitable material, such as a bent wire, and is pivotally attached to the lower rail 25 at the ends thereof by suitable means. The wicket 166 is free to pivot relative to the lower rail 25. When the handle assembly 100 is moved proximate to the side wall 20 of the trailer 12 and the T-shaped tongue 110 is engaged with the T-shaped slot 162, the cam 70, 72 is engaged with the respective wicket 166 by pivoting the wicket 166 relative to the side wall 20 and over the respective cam 70, 72, see FIG. 17. This aids in preventing wear on the T-shaped slot 162 by preventing rotation of the lockrod 54 and its associated cam 70, 72 relative to the side wall 20.

Although operation or usage of the door lock mechanism 50 has been discussed above to some extent in describing the structure of the door lock mechanism 50, operation or usage of the door lock mechanism 50 will now be described in more detail.

Initially, the doors 26 of the trailer 12 may be in the closed and locked position, as shown in FIG. 3. At this time, the upper and lower cams 70, 72 of each door lock mechanism 50 (i.e. the left, or roadside, door lock mechanism and the right, or curbside, door lock mechanism) are engaged with their respective keepers 74, 76. Additionally, the pins 140 which extend from the levers 120 are disposed in the T-shaped slots 112, generally above the T-shaped tongues 110 which are also disposed in the T-shaped slots 112, see FIG. 11.

When the doors 26 are in the closed and locked position as shown in FIG. 3, padlocks 136 may be engaged with the latch 106 and lever 120 of each door lock mechanism 50, as shown in FIG. 13, and pins may be engaged with the apertures 90 in the lower keepers 76 and in the cut outs 88 in the extending portion 80 of the lower cams 72, further securing the door lock mechanism 50. To open the doors 26, initially the pins, if provided, are disengaged from the apertures 90 in the lower keepers 76 and from the cut outs 88 in the extending portion 80 of the lower cams 72, and the padlocks 136, if provided, are unlocked and disengaged from the levers 120 and latches 106. Subsequently, the levers 120 are rotated to the open position, as shown in FIG. 14. Then, the levers 120 are pulled out, as shown in FIGS. 9 and 15. Pulling the levers 120 out causes the pin 140 to withdraw from the T-shaped slot 112. Subsequently, the handles 102 can be lifted, as shown in FIGS. 9 and 16, thereby causing the T-shaped tongue 110 to shift upward in the T-shaped slot (as represented by arrow 164 in FIG. 9), to the position shown in FIG. 12. Subsequently, the handles 102 can be rotated generally outward as shown in FIG. 10, thereby causing the upper and lower cams 70, 72 and lockrod 54 of each door lock mechanism 50 to rotate. Hence, the cams 70, 72 disengage from their respective keepers 74, 76, and the doors 26 can be swung open.

When the doors are swung fully open as shown in FIG. 17, the doors 26 can be secured in the open position by engaging the pins 140 and T-shaped tongues 110 of each door lock mechanism 50 with the T-shaped slots 164. The wickets 166 are engaged with the respective cams 70, 72. Additionally, the padlocks 136 can be engaged with the latches 106 and levers 120 to lock the doors 26 in the open position, if desired.

Attention is invited to the second embodiment of the novel door lock mechanisms 50' shown in FIGS. 19–33. The door lock mechanisms 50' are provided on the rear doors 26. One door lock mechanism 50' is provided for locking the right, or "curbside," door, and another door lock mechanism 50' is provided for locking the left, or "roadside," door. Many components of the left-side door lock mechanism are identical to those of the right-side door lock mechanism, and the other components of the left-side door lock mechanism mirror corresponding components of the right-side door lock mechanism. For clarity, the right-side door lock mechanism is primarily shown in the drawings and described hereinbelow.

Components in the second embodiment of the door lock mechanism 50' which are identical to components in the first embodiment of the door lock mechanism 50 are denoted with a prime after the number and are not redescribed. The second embodiment of the door lock mechanism 50' provides an alternate embodiment of the handle assembly 200 and locking means, but otherwise, the components of the door locking mechanisms 50, 50' are identical.

As shown in FIGS. 9 and 10, the lower cam 72' is a component of the handle assembly 200. The handle assembly 200 can be engaged with a T-shaped slot 206 in the trailer 12 to lock the door 26 in the closed position. In addition, the handle assembly 200 can be engaged with a T-shaped slot 230 on the side of the trailer 12 to lock the door 26 in the open position. The novel handle assembly 200 is provided below the doors 26 such that when the doors 26 are swung to the open position, the handle assembly 200 will not bear against the side walls 20 and will instead bear against the metal base rail 25.

The T-shaped slots 206 are provided in the base portion 29 of the rear frame 28 below the respective door 26. As shown in FIG. 23, the T-shaped slot 206 includes a narrow, bottom portion 207 and a wider, top portion 209 which is perpendicular to the narrow bottom portion 207. The narrow bottom portion 207 is offset from the center point of the wider top portion 209.

Figure 33:
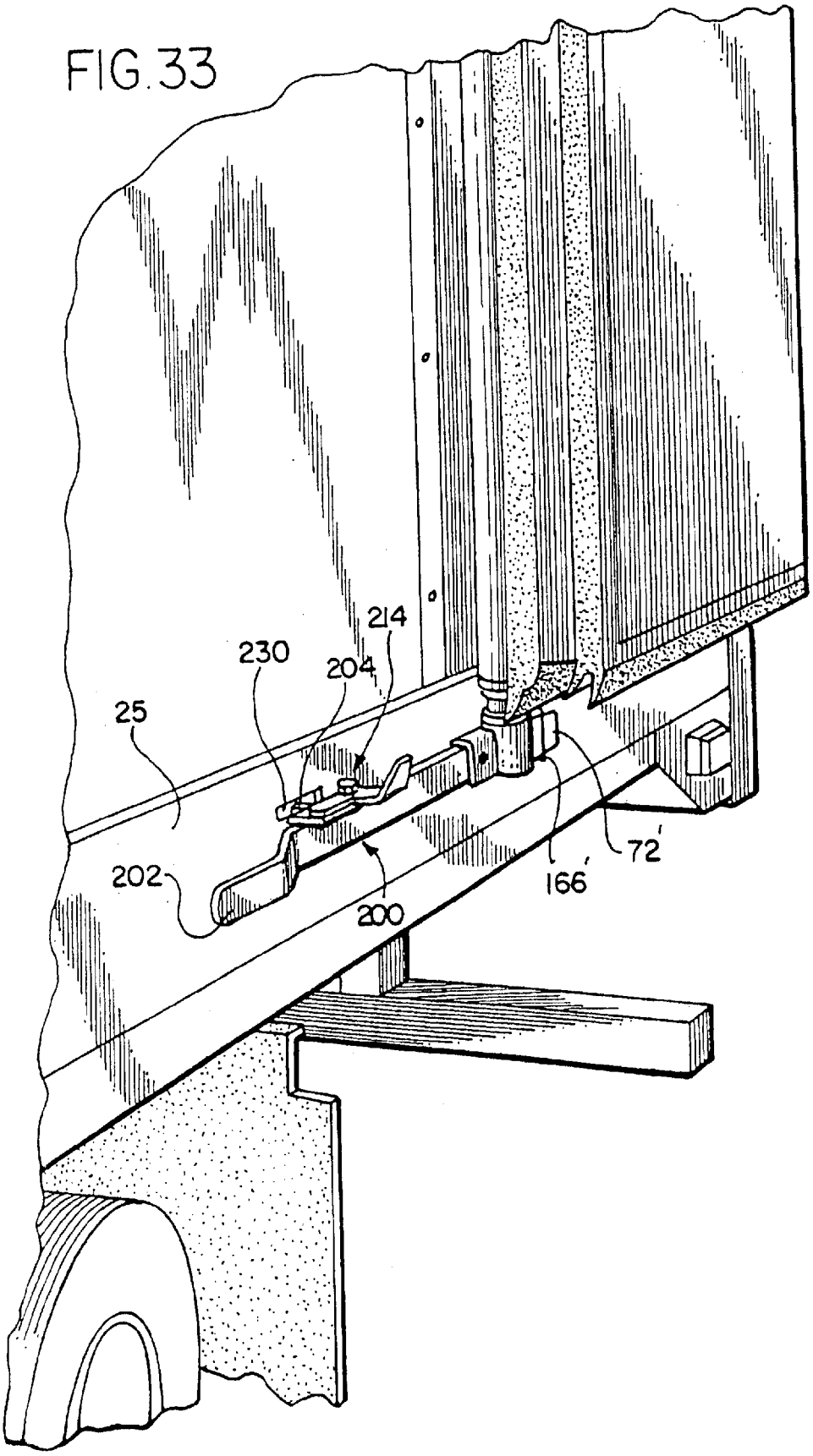
FIG. 33 is a left perspective view of the trailer showing the left door (i.e., the roadside door) in an open position, and showing the left-side (i.e., roadside) door lock mechanism of FIG. 19 engaged with corresponding structure on the trailer, thereby locking the door in an open position.

The T-shaped slots 230 are provided through the bottom rail 25 on each side of the trailer 12, see FIG. 33. Each T-shaped slot 230 includes a narrow bottom portion 232, and a wider top portion 234 which is perpendicular to the narrow bottom portion 232. The narrow bottom portion 232 is offset from the center point of the wider top portion 234. FIG. 33 illustrates such a T-shaped slot 230 provided on the left side, or roadside side, of the trailer 12.

The handle assembly 200 includes an elongated handle 202 which is pivotally connected to the lower cam 72'. Preferably, the handle 202 is attached to the lower cam 72' by a pin 298 or some other means which allows the handle 202 to pivot relative to the cam 72'. The handle assembly 200 is preferably formed of steel or some other suitable material. As will be described more fully later herein, the handle assembly 200 is configured such that the handle 202 can be manipulated to lock and unlock the door 26.

As shown in FIGS. 21–25, 28 and 29, the handle assembly 200 also includes a dog 204 extending generally perpendicular from the handle 202 and configured to engage the narrow, bottom portion 207 of the T-shaped slot 206 in the base portion 29 of the rear frame 28 of the trailer 12 or to engage the narrow, bottom portion 234 of the T-shaped slot 230 in the base rail 25 of the trailer 12, thereby generally securing the handle 202 in place. Specifically, the dog 204 includes a narrow neck portion 208, and a wider head portion 210 at the end of the neck portion 208. The topmost edge of the head portion 210 lies flush with the top edge of the neck portion 208 and the remainder hangs below the bottom edge of the neck portion 208 to form a lip 212. The dog 204 engages the narrow, bottom portion 207 of the T-shaped slot 206 and the lip 212 provides that the dog 204 can be withdrawn from the T-shaped slot 206 only when the handle 202 is in a raised position. Alternatively, the dog 204 engages the narrow, bottom portion 234 of the T-shaped slot 230 and the lip 212 provides that the dog 204 can be withdrawn from the T-shaped slot 230 only when the handle 202 is in a raised position.

The handle assembly 200 also includes a structure 214 that is secured to the handle 202. The structure 214 is inclined at a predetermined angle relative to the handle 202. The structure 214 includes a square base portion 216 which is secured to the handle 202 by a weld or other suitable means, and an L-shaped member 218 which is connected to the base portion 216 by a bolt 217 or other suitable means which allows the L-shaped member 218 to pivot relative to the base portion 216. The base portion 216 includes an aperture 224 therein and a protuberance 228 thereon which are spaced apart from each other.

The L-shaped member 218 includes a gripping portion 219 and a tongue portion 220 which is perpendicular to the gripping portion 219. The gripping portion 219 has a first aperture 222 therethrough and a second aperture 226 therethrough which are spaced apart from each other. The free end of the gripping portion 219 is angled relative to the tongue portion 220.

The tongue portion 220 is configured to be received in the wider, top portion 209 of the corresponding T-shaped slot 206 in the rear frame 28 of the trailer 12 above the dog 204, thereby securing the dog 204 in engagement with the narrow bottom portion 207 of the T-shaped slot 206 and further securing the handle 202 in place. The L-shaped member 218 is configured such that when the dog 204 is placed in engagement with the T-shaped slot 206, the tongue portion 220 moves into engagement with the T-shaped slot 206 primarily by the force of gravity, but the L-shaped member 218 is configured such that it can also be manually manipulated to engage or disengage the T-shaped slot 206.

In addition, the tongue portion 220 is configured to be received in the wider, top portion 232 of the corresponding T-shaped slot 230 in the base rail 25 of the trailer 12 above the dog 204, thereby securing the dog 204 in engagement with the narrow bottom portion 234 of the T-shaped slot 230 and further securing the handle 202 in place. The L-shaped member 218 is configured such that when the dog 204 is placed in engagement with the T-shaped slot 230, the tongue portion 220 moves into engagement with the T-shaped slot 230 primarily by the force of gravity, but the L-shaped member 218 is configured such that it can also be manually manipulated to engage or disengage the T-shaped slot 230.

FIGS. 21–23 depict the rear door 26 and the handle assembly 200 in the closed position. When the handle assembly 200 is in the closed position, the first aperture 222 in the L-shaped member 218 aligns with the aperture 224 in the base portion 216 of the structure 214, see FIGS. 20, 24 and 29 for clarity. As shown in FIG. 22, this provides that a pin, lock 300 or other suitable means, depicted by the phantom lines in FIG. 22, can be used to effectively lock the L-shaped member 218 and the base portion 216 together, thereby securing the handle assembly 200 in a closed position. Also, when the handle assembly 200 is in the closed position, the second aperture 226 in the L-shaped member 218 engages with the protuberance 228 on the base portion 216, thereby further securing the structure 214 in a closed position.

When the L-shaped member 218 is engaged with the T-shaped slot 206, the tongue portion 220 is disposed within the wider top portion 209 of the T-shaped slot 206 and above the dog 204. As a result, the dog 204 cannot be lifted in the T-shaped slot 206, such as by lifting up on the handle 202, and withdrawn from the T-shaped slot 206. In contrast, when the L-shaped member 218 is disengaged from the T-shaped slot 206, the tongue portion 220 is withdrawn from above the dog 204. When the tongue portion 220 is withdrawn from above the dog 204, the handle 202 can be lifted to move the dog 204 into the wider top portion 209 of the T-shaped slot 206. Subsequently, the handle 202 can be pulled away from the rear frame 28 of the trailer 12 to withdraw the dog 204 from the T-shaped slot 206. As the handle 202 is pulled away from the rear frame 28 of the trailer 12, the cams 70', 72' and lockrod 54' rotate, causing the upper and lower cams 70', 72' to disengage from their respective keepers 74', 76'. Then, the door 26 can be swung open.

When the door 26 is swung to the fully open position such that the door 26 is adjacent to the side wall 20 of the trailer 12, the handle assembly 200 can be secured to the T-shaped slot 230 through the bottom rail 25 of the trailer 12 to retain the door 26 in the open position much like how the door 26 is retained in the closed position by engaging the dog 204 and tongue portion 220 with the T-shaped slot 206 on the rear of the trailer 12. The wickets 166' are engaged with the respective cams 70', 72'. Of course, a pin, lock or other suitable means, as depicted by the phantom lines in FIG. 22, can be engaged with the structure 214 when the structure 214 is in a closed position so as to lock the structure 214 thereby locking the door 26 in the open position, much like how the structure 214 is locked when the door 26 is retained in the closed position.

Although operation or usage of the door lock mechanism 50' has been discussed above to some extent in describing the structure of the door lock mechanism 50', operation or usage of the door lock mechanism 50' will now be described in more detail.

Figure 19:
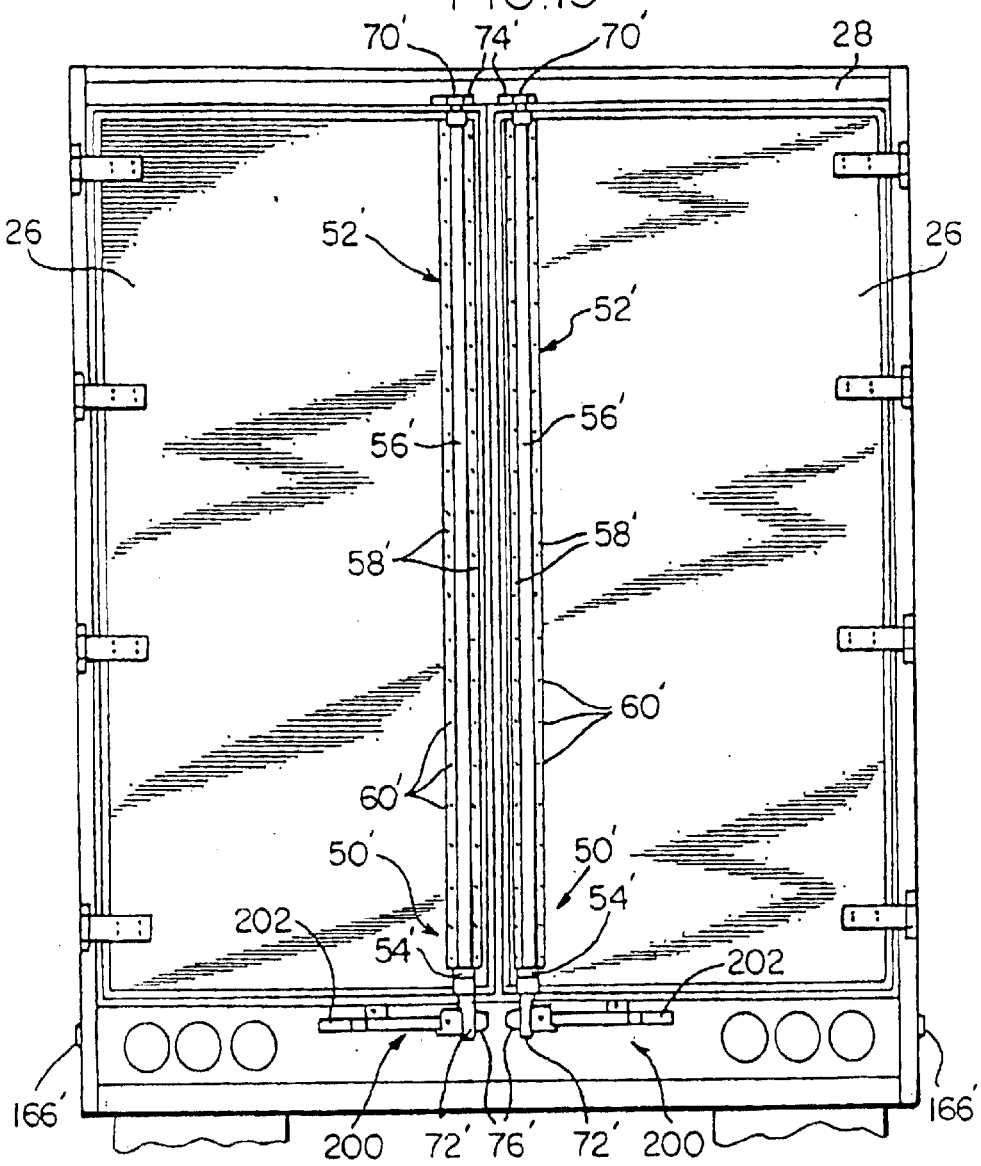
FIG. 19 is a rear elevational view of a trailer, showing door lock mechanisms associated with rear doors of a trailer which incorporate the features of a second embodiment of the present invention.
Figure 20:
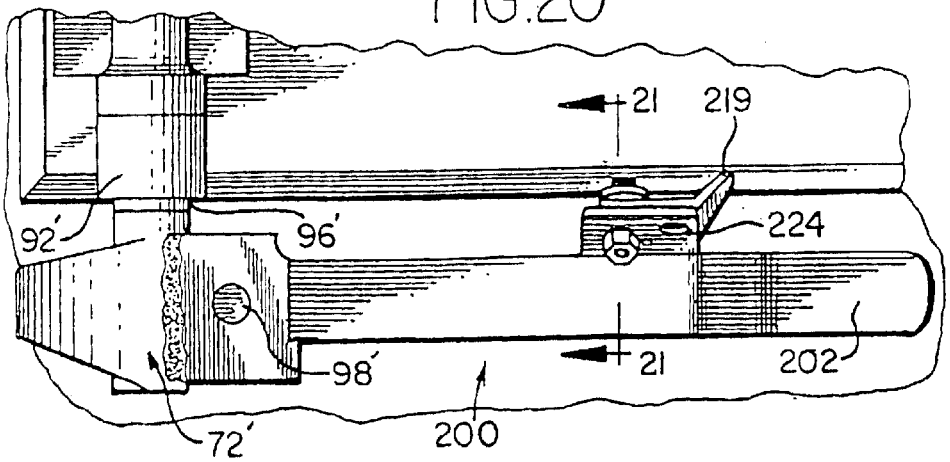
FIG. 20 is a plan view of the right-hand side (i.e., curbside) door lock mechanism shown in FIG. 19 showing a bottom portion of the door lock mechanism engaged with corresponding structure on the trailer.
Figure 24:
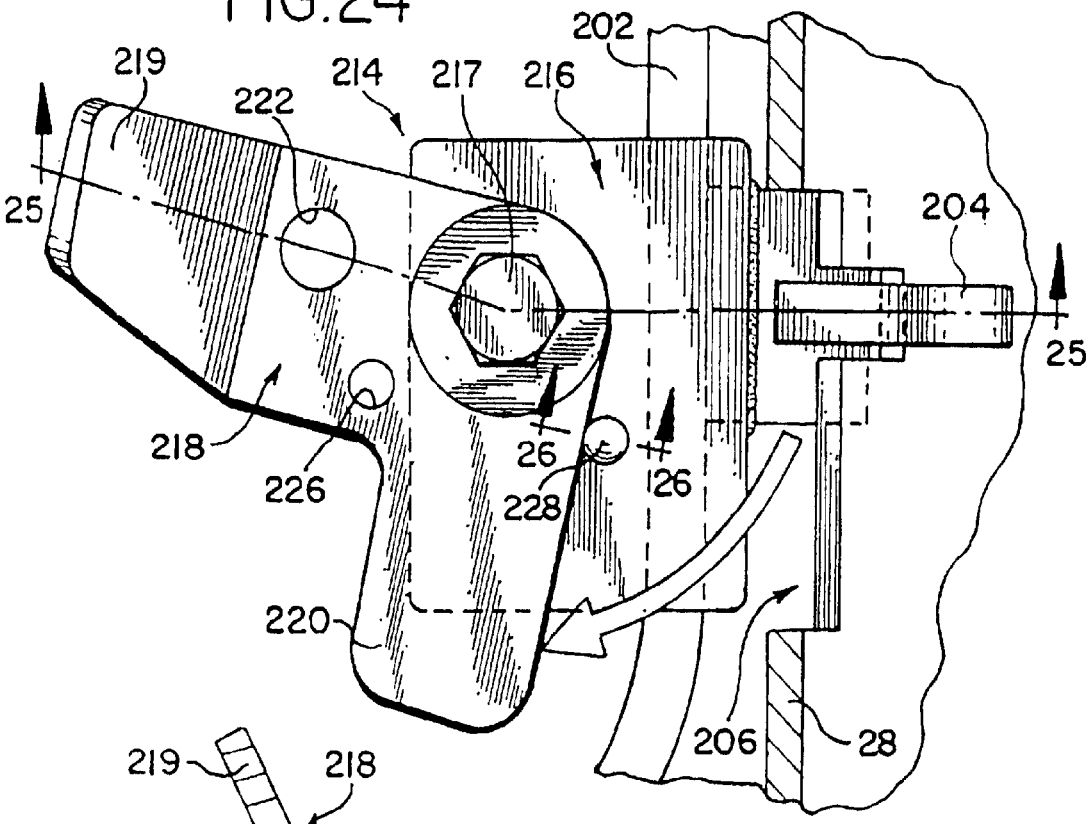
FIG. 24 is a view similar to FIG. 22, but showing the door lock mechanism of FIG. 19 being disengaged from corresponding structure on the trailer.
Figure 25:
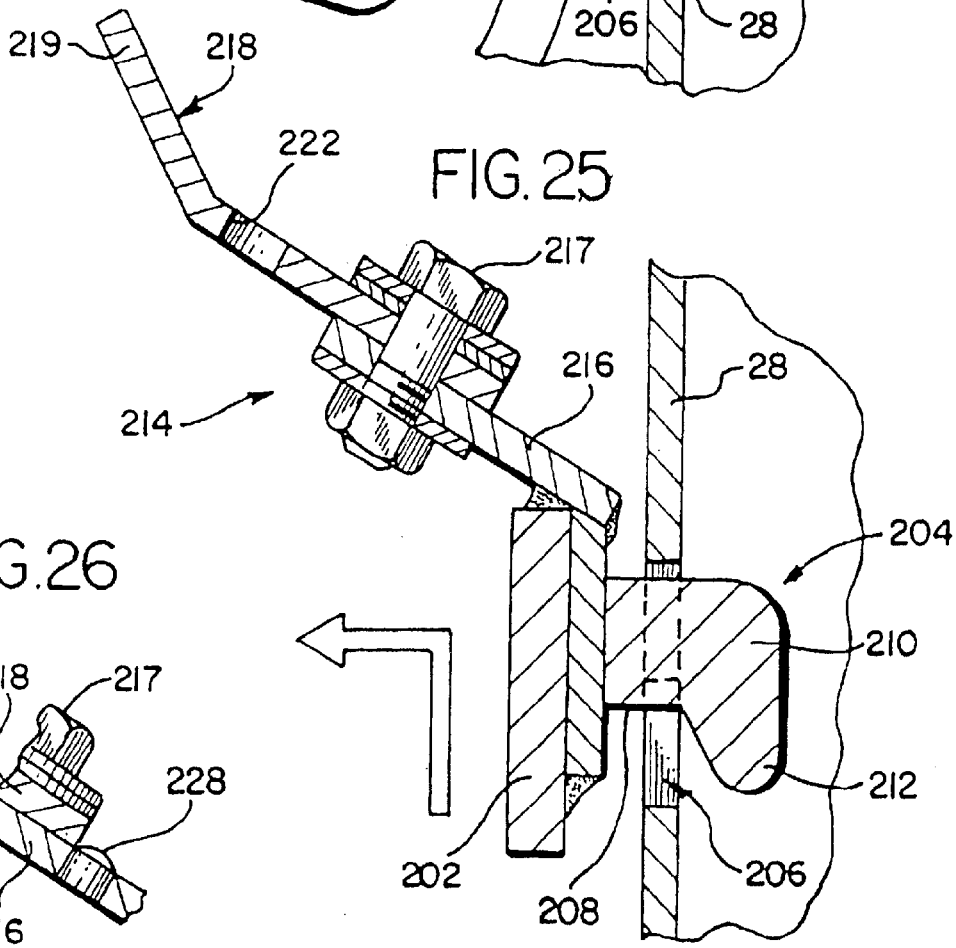
FIG. 25 is a cross-sectional view of the structure on the right-hand side (i.e., curbside) door lock mechanism shown in FIG. 19, taken along line 25—25 of FIG. 24 and is a view similar to FIG. 21, but showing the door lock mechanism being disengaged from corresponding structure on the trailer.
Figure 26:
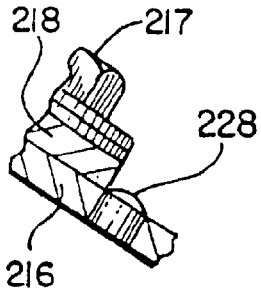
FIG. 26 is a cross-sectional view of the structure on the right-hand side (i.e., curbside) door lock mechanism shown in FIG. 19, taken along line 26—26 of FIG. 24.
Figure 27:
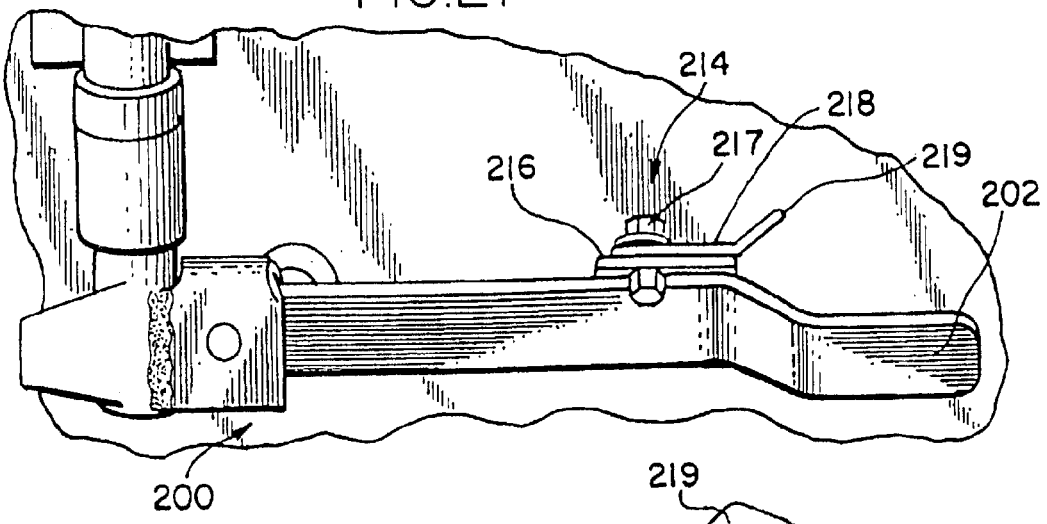
FIG. 27 is a perspective view of a lower portion of the right-hand side (i.e., curbside) door lock mechanism shown in FIG. 19, showing the handle assembly in engagement with a corresponding structure on the trailer thereby locking the handle in place.
Figure 29:
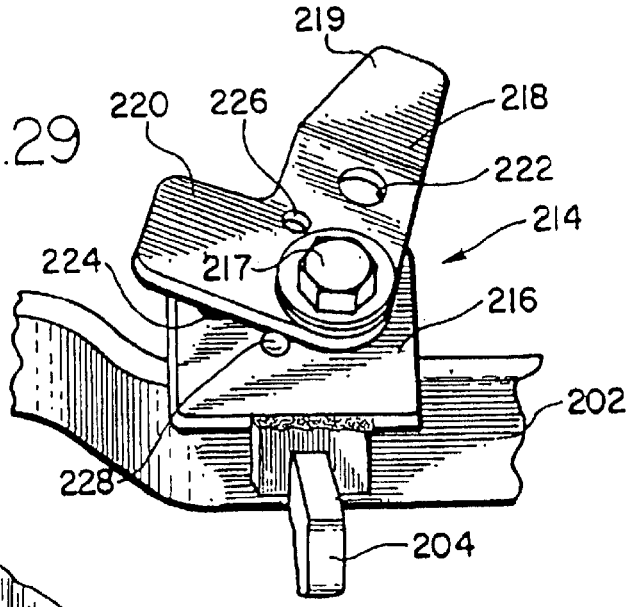
FIG. 29 is a partial perspective view of the right-hand side (i.e., curbside) door lock mechanism shown in FIG. 19, eliminating the handle of the door lock mechanism for clarity.
Figure 28:
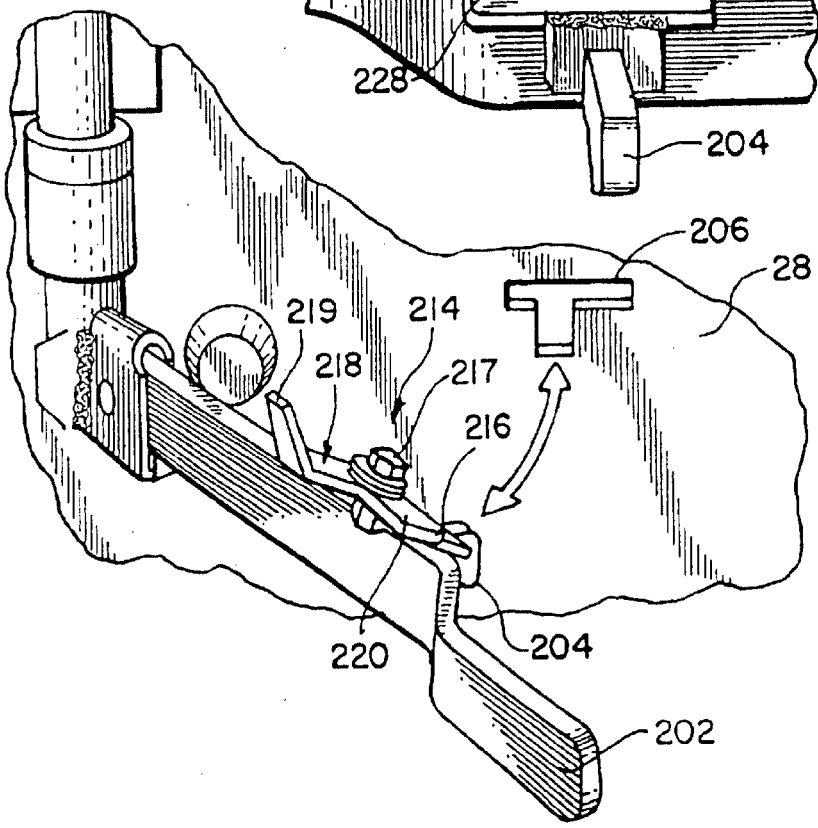
FIG. 28 is a view similar to FIG. 27, but showing the door lock mechanism of FIG. 19 being disengaged from corresponding structure on the trailer.
Figure 30:
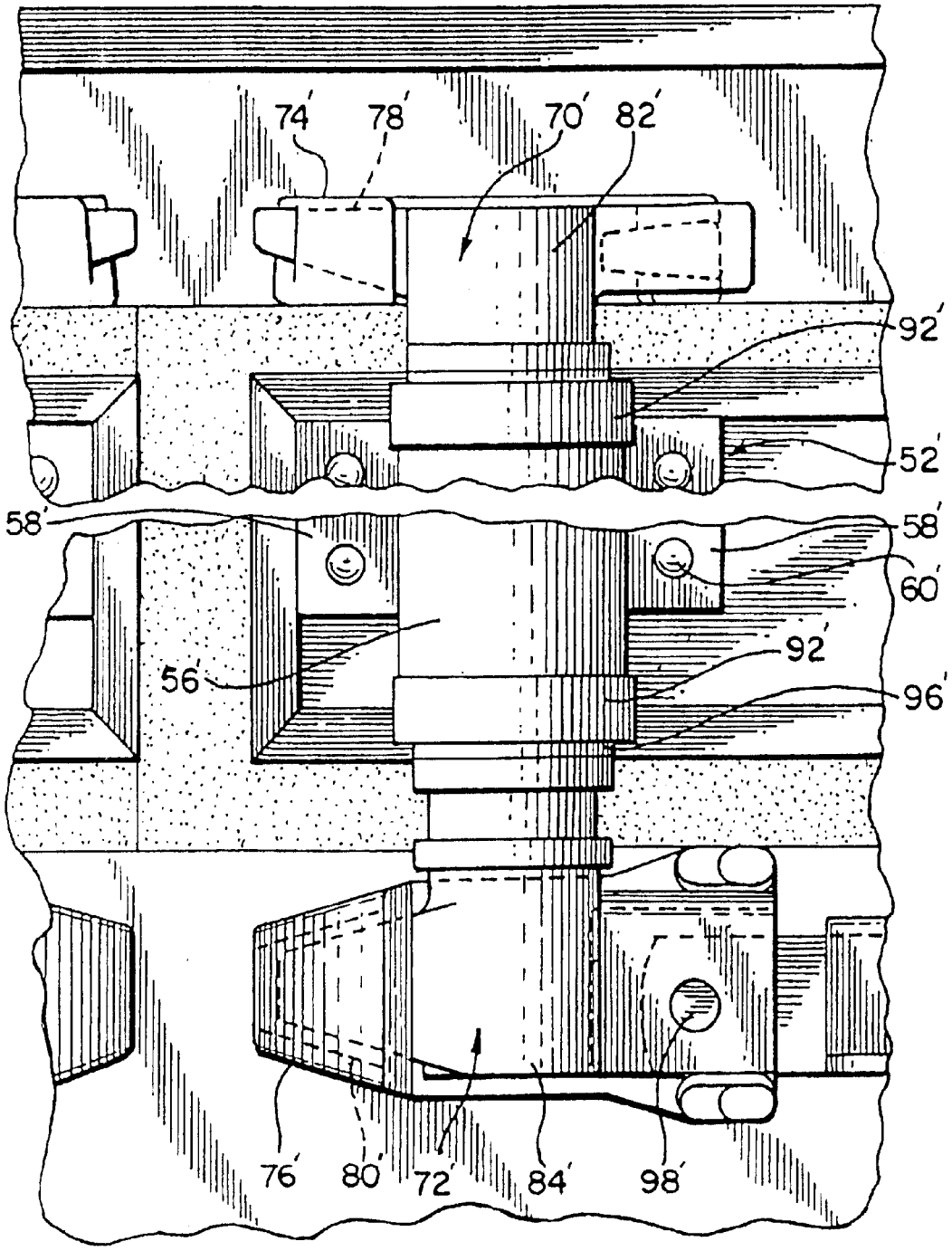
FIG. 30 is a plan, broken view of the right-hand side (i.e., curbside) door lock mechanism shown in FIG. 19, showing top and bottom portions of the door lock mechanism engaged with corresponding structures on the trailer.
Figure 31:
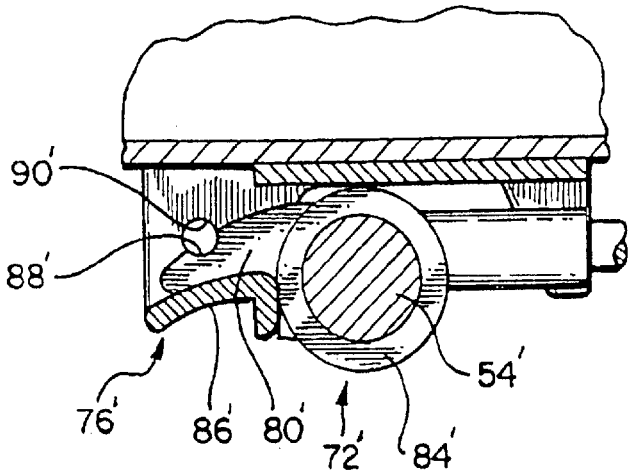
FIG. 31 is a cross-sectional view of the right-hand side (i.e., curbside) door lock mechanism shown in FIG. 19, omitting the handle for clarity.
Figure 32:
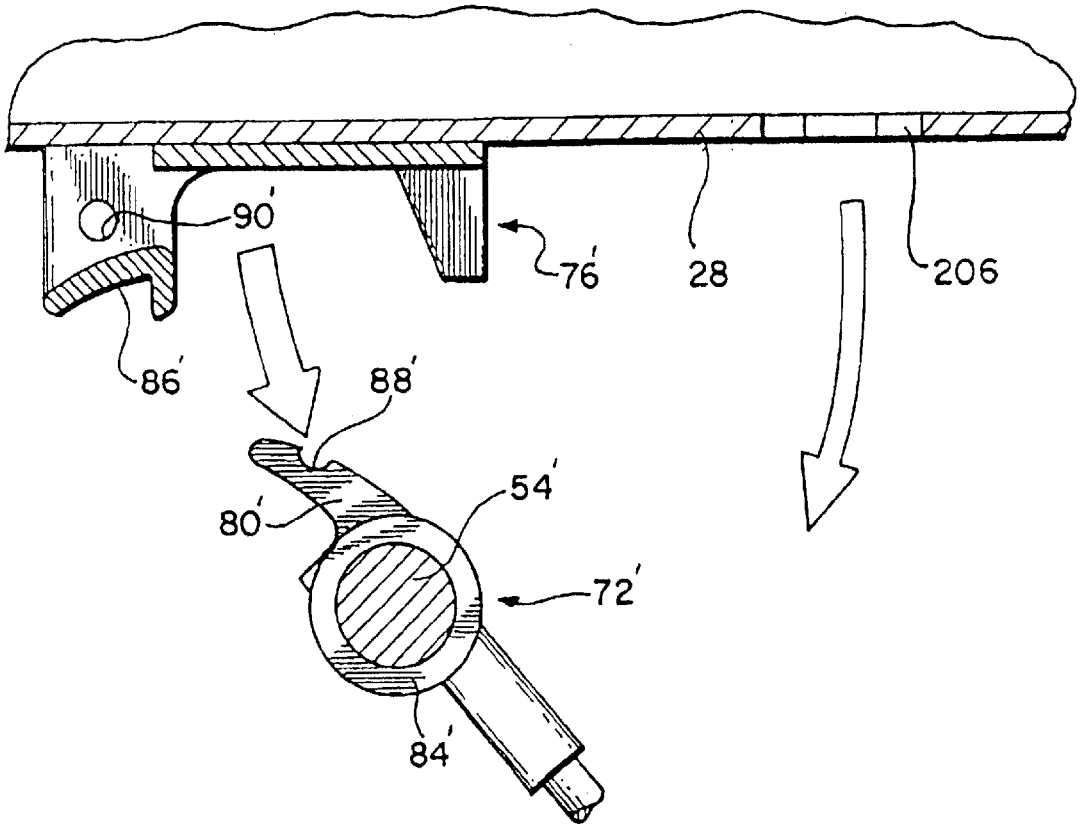
FIG. 32 is a view similar to FIG. 31, but showing a handle assembly of the door lock mechanism being disengaged from corresponding structure on the trailer.

Initially, the doors 26 of the trailer 12 may be in the closed and locked position, as shown in FIG. 19. At this time, the upper and lower cams 70', 72' of each door lock mechanism 50' (i.e., the left, or roadside, door lock mechanism and the right, or curbside, door lock mechanism) are engaged with their respective keepers 74', 76'. Additionally, the tongue portions 220 are disposed in the wider, top portion 209 of the T-shaped slots 206, generally above the dogs 204 which are disposed in the narrow, bottom portion 207 of the T-shaped slots 206. Therefore, the dogs 204 cannot be removed from the respective T-shaped slots 206 until the tongue portions 220 are removed.

When the doors 26 are in the closed and locked position as shown in FIG. 19, a lock 300, see FIG. 22, or other suitable means may be engaged with the first apertures 222 in the L-shaped members 218 and the apertures 224 in the base portions 216 of the structures 214 of each door lock mechanism 50', and the second apertures 226 in the L-shaped members 218 are in engagement with the protuberances 228 on the base portions 216 of the structures 214, thereby securing each door lock mechanism 50' in the closed position. Additionally, pins or other suitable means may be engaged with the apertures 90' in the lower keepers 76' and in the cut-outs 88' in the extending portion 80' of the lower cams 72', securing the doors 26 in a closed position.

To open the doors 26, initially the pins, if provided, are disengaged from the apertures 90' in the lower keepers 76' and from the cut-outs 88' in the extending portion 80' of the lower cams 72' by the operator, and the locks 300, if provided, are disengaged from the structures 214 by the operator. Subsequently, the gripping portions 219 are grasped by the operator and the L-shaped members 218 are rotated such that the apertures 226 in the L-shaped members 218 are disengaged from the protuberances 228 on the base portions 216, and the L-shaped members 218 are moved to the open position, thereby removing the tongue portions 220 from engagement with the T-shaped slots 206. The handles 202 are then lifted by the operator, thereby causing the dogs 204 to shift upward in the T-shaped slots 206. Subsequently, the handles 202 are rotated outward by the operator, thereby causing the upper and lower cams 70', 72' and lockrod 54' of each door lock mechanism 50' to rotate. Hence, the cams 70', 72' disengage from their respective keepers 74', 76', and the doors 26 can be swung open by the operator.

When the doors 26 are swung fully open such that the doors 26 are proximate to the side walls 20, the doors 26 can be secured in the open position by engaging the structures 214 with the T-shaped slots 230 on either side of the trailer 12. The handle 202 can be lifted and rotated towards the side wall 20 by the operator, thereby allowing the dog 204 to pass through the T-shaped slot 230. The handle 202 is then lowered by the operator, thereby engaging the dog 204 with the narrow bottom portion 232 of the T-shaped slot 230 thus preventing the handle 202 from being removed again without raising the handle 202 first. Subsequently, the operator can lightly push or tap the gripping portion 219 of the L-shaped member 218 and because of the inclination of the structure 214 relative to the handle 202, the L-shaped member 218 of the structure 214 is moved into engagement with the wider top portion 234 of the T-shaped slot 230 by the force of gravity. The aperture 226 in the L-shaped member 218 is moved into engagement with the protuberance 228 on the base portion, thereby securing the dog 204 in engagement with the narrow bottom portion 232 of the T-shaped slot 230. The first apertures 222 in the L-shaped member 218 and the apertures 224 in the base portions 216 align with each other. If provided, the locks 300 can be engaged with the first apertures 222 in the L-shaped members 218 and the apertures 224 in the base portions 216 of the structures 214 of each door lock mechanism 50' by the operator, thereby securing the door lock mechanism 50' in the closed position and securing the doors 26 in the open position. The wickets 166' are engaged with the respective cams 70', 72'.

After disengagement of the wickets 166' with the respective cams 70', 72', the doors 26 can again be disengaged from the T-shaped slots 230 on either side of the trailer 12 as described above.

When the doors 26 are swung closed by the operator, the handles 202 are lifted and rotated inward by the operator, thereby allowing the dogs 204 to pass through the T-shaped slots 206, and causing the upper and lower cams 70', 72' and lockrods 54' of each door lock mechanism 50' to rotate. Hence, the cams 70', 72' engage their respective keepers 74', 76'. The handles 202 are then lowered by the operator, thereby engaging the dogs 204 with the narrow bottom portions 207 of the T-shaped slots 206 thus preventing the handles 202 from being removed again without raising the handles 202 first. Subsequently, the operator can lightly push or tap the gripping portion 219 of the L-shaped member 218 and because of the inclination of the structures 214 relative to the handles 202, the tongue portions 220 of the L-shaped members 218 of the structures 214 are moved into engagement with the wider top portions 209 of the T-shaped slots 206 by the force of gravity. The second apertures 226 in the L-shaped members 218 are again moved into engagement with the protuberances 228 on the base portions 216, thereby securing the dogs 204 in engagement with the narrow bottom portions 207 of the T-shaped slots 206. The first apertures 222 in the L-shaped member 218 and the apertures 224 in the base portions 216 align with each other. If provided, the pins can be engaged with the apertures 90' in the lower keepers 76' and the cut-outs 88' in the extending portions 80' of the lower cams 72' by the operator. Also, if provided, the locks 300 can be engaged with the first apertures 222 in the L-shaped members 218 and the apertures 224 in the base portions 216 of the structures 214 of each door lock mechanism 50' by the operator, thereby securing the door lock mechanisms 50' in the closed position.

It is to be understood that a recess can be provided instead of the second aperture 226 in the L-shaped member 218 for engagement with the protuberance 228 on the base portion 216.

The provision of the full length sleeve 52, 52' which the lockrod 54, 54' rotates reinforces the door 26 from bending (in the same manner as a post in a side wall 20 of the trailer 26), and takes the thrust load along the entire height of the door 26. In addition, the sleeve 52, 52' protects the lockrod 54, 54' from damage. Also, the sleeve 52, 52' allows for a smooth decal on the rear doors 26 of the trailer 12. Moreover, providing the handle 102, 202 below the door 26 allows the sleeve 52, 52' to be continuous. If the handle were to interrupt the sleeve, the sleeve would not reinforce the door 26.

While preferred embodiments of the present invention are shown and described, it is envisioned that those skilled in the art may devise various modifications of the present invention without departing from the spirit and scope of the appended claims.

The invention claimed is:

1. A trailer comprising:

a floor;

a rear frame having an opening therethrough and structure on a bottom portion thereof;

a door mounted in said rear frame;

a lockrod mounted to said door; and a handle assembly connected to said lockrod, said handle assembly having a first structure thereon configured to engage said structure on said bottom portion of said rear frame, thereby locking said door in place, said handle assembly configured for actuation to rotate said lockrod, thereby selectively locking and unlocking said door, said handle assembly including a handle and a second structure provided on said handle and configured to engage into said opening in said rear frame, thereby locking said handle in place and preventing further substantial movement of said handle relative to said door, said second structure including a dog provided on said handle configured to engage said opening, a member provided on said handle and configured to engage said opening such that said member is adjacent said dog within said opening, said member preventing the removal of said dog from said opening.

2. A trailer as defined in claim 1, wherein said rear frame includes top structure thereon and a top of said lockrod includes structure thereon configured to engage said corresponding top structure on said rear frame, and a bottom of said lockrod is connected to said handle assembly.

3. A trailer as defined in claim 1, further including a sleeve in which said lockrod is disposed, an end cap disposed at an end of said sleeve, said lockrod extending through an opening in said end cap, and a thrust bearing disposed between said end cap and said handle assembly.

4. A trailer as defined in claim 1, wherein said first structure on said handle assembly comprises a cam.

5. A trailer as defined in claim 1, wherein said handle assembly hangs below the door.

6. A trailer as defined in claim 1, wherein said member includes a tongue disposed on said handle, a lever disposed on said handle, said lever including a pin that extends through an aperture in said handle, said lever configured such that said lever can be manipulated relative to said handle to provide that said pin is disposed adjacent said tongue.

7. A trailer as defined in claim 6, wherein said opening is generally T-shaped and said tongue is generally T-shaped for engagement therewith.

8. A trailer as defined in claim 1, wherein said second structure further includes a handle, said dog being provided on said handle to engage said opening in said rear frame.

9. A trailer as defined in claim 8, wherein said member includes a gripping portion and a tongue portion, said tongue portion configured to move into engagement with said opening in said rear frame.

10. A trailer as defined in claim 8, wherein said member is generally L-shaped.

11. A trailer as defined in claim 8, wherein said member is inclined at a predetermined angle relative to said handle.

12. A trailer as defined in claim 8, wherein said second structure further includes a base portion on which said member is mounted, said base portion having an aperture therethrough, said member including an aperture therethrough configured such that when said member is in engagement with said opening in said rear frame, said aperture through said member is in alignment with said aperture through said base portion such that an associated pin can be inserted through said apertures.

13. A trailer as defined in claim 8, wherein said second structure further including a base portion on which said member is mounted, said base portion having a protuberance thereon, wherein said member includes an aperture therethrough such that when said member is in engagement with the corresponding opening in the trailer, said aperture is in engagement with said protuberance on said base portion.

14. A trailer as defined in claim 8, wherein said second structure further includes a base portion, wherein said member is pivotally mounted on said base portion.

15. A trailer as defined in claim 8, wherein said member includes a tongue portion, said member being configured such that said tongue portion can be manipulated relative to said structure to provide that said tongue portion is disposed adjacent said dog.

16. A door lock mechanism configured for use with a trailer having a door, the door defining a plane, said door lock mechanism comprising:

a lockrod mounted on the door; and a handle assembly connected to said lockrod, said handle assembly having a first structure thereon configured to engage corresponding structure on the trailer, thereby locking the door in place, said handle assembly configured for actuation to rotate said lockrod, thereby selectively locking and unlocking the door, said handle assembly including a handle and a second structure provided on said handle and configured to engage a corresponding structure on the trailer, thereby locking said handle in place, said second structure including a dog provided on said handle to engage a corresponding opening on the trailer, a member provided on said handle and configured for engagement with the corresponding opening on the trailer, said member being inclined relative to a plane which is perpendicular to the plane defined by the door at an angle between zero and ninety degrees such that said member can be moved into engagement with said corresponding opening primarily by gravity.

17. A door lock mechanism as defined in claim 16, wherein a top of said lockrod has structure thereon is configured to engage corresponding structure on the trailer, and a bottom of said lockrod is connected to said handle assembly.

18. A door lock mechanism as defined in claim 16, further comprising an end cap disposed at an end of said sleeve, said lockrod extending through an opening in said end cap, and a thrust bearing disposed between said end cap and said handle assembly.

19. A door lock mechanism as defined in claim 16, said handle assembly having cam structure thereon configured to engage corresponding structure on the trailer.

20. A door lock mechanism as defined in claim 16, wherein said member is generally L-shaped.

21. A door lock mechanism as defined in claim 16, wherein said second structure further includes a base portion having an aperture therethrough, wherein said member includes an aperture therethrough configured such that when said member is in engagement with the corresponding opening in the trailer, said aperture through said member is in alignment with said aperture through said base portion such that an associated pin can be inserted through said apertures.

22. A door lock mechanism as defined in claim 16, wherein said member includes a tongue portion, said member being configured such that said tongue portion can be manipulated relative to said dog to provide that said tongue portion is disposed adjacent said dog.

23. A door lock mechanism as defined in claim 16, wherein said handle assembly hangs below the door.

24. A door lock mechanism as defined in claim 16, wherein said second structure further includes a base portion, wherein said member is pivotally mounted on said base portion.

25. A door lock mechanism configured for use with a trailer having a door, the door having an upper end and a lower end, said door lock mechanism comprising:

a continuous sleeve mounted on the door of the trailer, said sleeve having an upper end and a lower end, said sleeve extending along the door such that said upper end of said sleeve is proximate the upper end of the door and said lower end of said sleeve is proximate said lower end of the door;

a lockrod disposed generally in said sleeve, said lockrod being sandwiched between said sleeve and the door;

a handle assembly connected to said lockrod and external to said sleeve, said handle assembly hanging below the door; said handle assembly having structure thereon configured to engage corresponding structure on the trailer, thereby locking the door in place, said handle assembly configured for actuation to rotate said lockrod, thereby selectively locking and unlocking the door, said handle assembly having structure thereon configured to engage corresponding structure on the trailer, thereby locking the door in an open position.

26. A door lock mechanism as defined in claim 25, wherein said sleeve is formed from a generally U-shaped channel in which said lockrod is disposed and first and second rails disposed on opposite sides of said U-shaped channel, said first and said rails being attached to the door.

27. A door lock mechanism as defined in claim 25, further comprising an end cap disposed at an end of said sleeve, said lockrod extending through an opening in said end cap, and a thrust bearing disposed between said end cap and said handle assembly.

28. A door lock mechanism as defined in claim 27, wherein said thrust bearing is formed from high density polyethylene.

29. A door lock mechanism as defined in claim 27, wherein said thrust bearing is split.

30. A door lock mechanism as defined in claim 25, said handle assembly including a handle and a tongue configured to engage corresponding structure on the trailer, thereby locking said handle in place.

31. A door lock mechanism as defined in claim 30, said handle assembly further including a lever disposed on said handle, said lever including a pin that extends through an aperture in said handle, said lever configured such that said lever can be manipulated relative to said handle to provide that said pin is disposed adjacent said tongue, thereby locking said handle in place.

32. A door lock mechanism as defined in claim 30, wherein said tongue is generally T-shaped and is configured to engage a corresponding generally T-shaped slot on the trailer.

33. A door lock mechanism as defined in claim 25, said handle assembly including a handle, a dog configured to engage corresponding structure on the trailer, and a member configured for engagement with the corresponding structure on the trailer, said member being moved into engagement with said corresponding structure primarily by gravity.

34. A door lock mechanism as defined in claim 33, wherein said member is mounted on said handle and is inclined at a predetermined angle relative to said handle.

35. A door lock mechanism as defined in claim 33, wherein said member is generally L-shaped.

36. A door lock mechanism as defined in claim 35, wherein said dog and said member are configured to engage a generally T-shaped slot on the trailer.

37. A door lock mechanism as defined in claim 25, wherein said structure locking the door in place includes a cam thereon, and further comprising an end cap disposed at an end of said sleeve, said lockrod extending through an opening in said end cap, and a thrust bearing disposed between said end cap and said handle assembly, said handle assembly including a handle and handle structure configured to engage corresponding structure on the trailer, thereby locking said handle in place, wherein said handle structure is configured to engage corresponding handle receiving structure on the trailer, wherein a top of said lockrod has structure thereon configured to engage corresponding structure on the trailer, and a bottom of said lockrod is connected to said handle assembly.

38. A door lock mechanism as defined in claim 25, wherein said structure on said handle assembly configured to engage corresponding structure on the trailer includes a cam thereon, and wherein said corresponding structure on the trailer includes a retaining structure on the side of the trailer, such that when the door is in the open position, said cam is engaged with said retaining structure.

39. A door lock mechanism as defined in claim 38, wherein said retaining structure is a wicket which is pivotally attached to the side of the trailer.

40. A door lock mechanism configured for use with a trailer having a door, said door lock mechanism comprising:

a lockrod mounted on the door; and a handle assembly connected to said lockrod, said handle assembly having a first structure thereon configured to engage corresponding structure on the trailer, thereby locking the door in place, said handle assembly configured for actuation to rotate said lockrod, thereby selectively locking and unlocking the door, said handle assembly including a handle and a second structure provided on said handle and configured to engage corresponding structure on the trailer, thereby locking said handle in place, said second structure including a dog provided on said handle configured to engage an opening on the trailer, a member provided on said handle and configured to engage the opening on the trailer such that said member is adjacent said dog within said opening, said member preventing the removal of said dog from the opening on the trailer.

41. A door lock mechanism as defined in claim 40, wherein said member includes a tongue disposed on said handle, a lever disposed on said handle, said lever including a pin that extends through an aperture in said handle, said lever configured such that said lever can be manipulated relative to said handle to provide that said pin is disposed adjacent said tongue.

42. A door lock mechanism defined in claim 41, wherein said tongue is generally T-shaped.

43. A door lock mechanism as defined in claim 40, wherein said second structure includes a handle, said dog being provided on said handle to engage said opening, said member being moved into engagement with said opening primarily by gravity.

44. A door lock mechanism as defined in claim 43, wherein said member is inclined at a predetermined angle relative to said handle.

45. A door lock mechanism as defined in claim 43, wherein said second structure further includes a base portion, wherein said member is pivotally mounted on said base portion.

46. A door lock mechanism configured for use with a trailer having a door, said door lock mechanism comprising:

a sleeve mounted on the door of the trailer;

an end cap disposed at an end of said sleeve;

a lockrod disposed in said sleeve and extending through an opening in said end cap;

a lock provided at an end of said lockrod for preventing rotational movement of said lockrod when said lock is engaged with corresponding structure on the trailer;

a handle assembly connected to said lockrod and configured for actuation to rotate said lockrod; and a thrust bearing disposed between said end cap and said lock, said thrust bearing being in direct contact with said end cap and with said lock, said thrust bearing being rotatable relative to said end cap and relative to said lock.

47. A door lock mechanism as defined in claim 46, said handle assembly further including a handle, a tongue disposed on said handle, a lever disposed on said handle, said lever including a pin that extends through an aperture in said handle, said lever configured such that said lever can be manipulated relative to said handle to provide that said pin is disposed adjacent said tongue, thereby locking said handle in place.

48. A door lock mechanism as defined in claim 46, said handle assembly including a handle, a dog provided on said handle to engage a corresponding opening on the trailer, a member provided on said handle configured for engagement with the corresponding opening on the trailer, said member being moved into engagement with said corresponding opening primarily by gravity.

49. A door lock mechanism as definded in claim 46, wherein said thrust bearing is formed from high density polyethylene.

50. A door lock mechanism as defined in claim 46, wherein said thrust bearing is split.

51. A door lock mechanism as defined in claim 46, wherein said end cap is formed from stainless steel.

52. A door lock mechanism as defined in claim 46, wherein said lock comprises a cam provided on said lockrod which is configured to engage corresponding structure on the trailer.

53. A door lock mechanism as defined in claim 46, wherein said handle assembly hangs below the door.

54. A door lock mechanism configured for use with a trailer having a door, said door lock mechanism comprising:

a lockrod mounted on the door;

a handle assembly connected to said lockrod, said handle assembly having a first structure thereon configured to engage corresponding structure on the trailer, thereby locking the door in place, said handle assembly configured for actuation to rotate said lockrod, thereby selectively locking and unlocking the door, said handle assembly including a handle and a second structure provided on said handle and configured to engage corresponding structure on the trailer, thereby locking said handle in place, said second structure including a dog provided on said handle to engage a corresponding opening on the trailer, a member provided on said handle and configured for engagement with the corresponding opening on the trailer, said member being inclined relative to the horizontal at an angle between zero and ninety degrees such that said member can be moved into engagement with said corresponding opening primarily by gravity; and a securing member provided on a side of the trailer, and the door being capable of being moved to an open position such that the door is opened and swung proximate to the side wail of the trailer, and wherein when the door is in the open position, said first structure is engaged with said securing member.

55. A door lock mechanism as defined in claim 54, wherein said securing member is a wicket which is pivotally attached to the side of the trailer.

56. A trailer comprising:

a floor;

a rear frame having an opening therethrough and structure on a bottom portion thereof;

a door mounted in said rear frame;

a lockrod mounted to said door;

a handle assembly connected to said lockrod, said handle assembly having a first structure thereon configured to engage said structure on said bottom portion of said rear frame, thereby locking said door in place, said handle assembly configured for actuation to rotate said lockrod, thereby selectively locking and unlocking said door, said handle assembly including a handle and a second structure provided on said handle and configured to engage into said opening in said rear frame, thereby locking said handle in place and preventing further substantial movement of said handle relative to said door; and a side wall and base rail connecting said side wall to said floor, a securing member provided on said base rail, and said door being capable of being moved to an open position such that said door is opened and swung proximate to said side wall, and wherein when said door is in the open position, said first structure is engaged with said securing member.

57. A trailer as defined in claim 56, wherein said securing member is a wicket which is pivotally attached said base rail.

58. A door lock mechanism configured for use with a trailer having a door, said door lock mechanism comprising:

a lockrod mounted on the door; and a handle assembly connected to said lockrod, said handle assembly having a first structure thereon configured to engage first corresponding structure on the trailer, thereby locking the door in place, said handle assembly configured for actuation to rotate said lockrod, thereby selectively locking and unlocking the door, said handle assembly including a handle and a second structure provided on said handle and configured to engage second corresponding structure on the trailer, thereby locking said handle in place and preventing further substantial movement of said handle relative to the door, said second structure provided on said handle assembly including a handle, a dog provided on said handle configured to engage an opening on the trailer, a member provided on said handle configured for engagement with said opening, said member being moved into engagement with said opening primarily by gravity, said member including a gripping portion and a tongue portion, said tongue portion configured to move into engagement with said opening.

59. A door lock mechanism as defined in claim 58, wherein said member includes a tongue portion, said member being configured such that said tongue portion can be manipulated relative to said structure to provide that said tongue portion is disposed adjacent said dog.

60. A door lock mechanism configured for use with a trailer having a door, said door lock mechanism comprising:

a lockrod mounted on the door; and a handle assembly connected to said lockrod, said handle assembly having a first structure thereon configured to engage corresponding structure on the trailer, thereby locking the door in place, said handle assembly configured for actuation to rotate said lockrod, thereby selectively locking and unlocking the door, said handle assembly including a handle and a second structure provided on said handle and configured to engage corresponding structure on the trailer, thereby locking said handle in place, said second structure including a tongue disposed on said handle, a lever disposed on said handle, said lever including a pin that extends through an aperture in said handle, said tongue and said pin being insertable into an aperture on the trailer, said lever configured such that said lever can be manipulated relative to said handle to provide that said pin is disposed adjacent said tongue when inserted into the aperture.

61. A door lock mechanism as defined in claim 60, wherein said tongue is generally T-shaped and said aperture is generally T-shaped.

62. A door lock mechanism configured for use with a trailer having a door, said door lock mechanism comprising:

a lockrod mounted on the door; and a handle assembly connected to said lockrod, said handle assembly having a first structure thereon configured to engage corresponding structure on the trailer, thereby locking the door in place, said handle assembly configured for actuation to rotate said lockrod, thereby selectively locking and unlocking the door, said handle assembly including a handle and a second structure provided on said handle and configured to engage corresponding structure on the trailer, thereby locking said handle in place, said second structure including a dog provided on said handle to engage a corresponding opening on the trailer, a member provided on said handle and configured for engagement with the corresponding opening on the trailer, said member being moved into engagement with said corresponding opening primarily by gravity, said second structure further includes a base portion having a protuberance thereon, wherein said member includes an aperture therethrough such that when said member is in engagement with the corresponding opening in the trailer, said aperture is in engagement with said protuberance on said base portion.

63. A door lock mechanism configured for use with a trailer having a door, said door lock mechanism comprising:

a lockrod mounted on the door; and a handle assembly connected to said lockrod, said handle assembly having a first structure thereon configured to engage corresponding structure on the trailer, thereby locking the door in place, said handle assembly configured for actuation to rotate said lockrod, thereby selectively locking and unlocking the door, said handle assembly including a handle and a second structure provided on said handle and configured to engage corresponding structure on the trailer, thereby locking said handle in place, said second structure including a dog provided on said handle to engage a corresponding opening on the trailer, a member provided on said handle and configured for engagement with the corresponding opening on the trailer, said member including a gripping portion and a tongue portion, said tongue portion configured to move into engagement with the corresponding opening on the trailer, said member being inclined relative to the horizontal at an angle between zero and ninety degrees such that said member can be moved into engagement with said corresponding opening primarily by gravity.

* * * * *

UNITED STATES PATENT AND TRADEMARK OFFICE

CERTIFICATE OF CORRECTION

PATENT NO. : 6,886,870 B2
DATED : May 3, 2005
INVENTOR(S) : Rodney P. Ehrlich

It is certified that error appears in the above-identified patent and that said Letters Patent is hereby corrected as shown below:

Title page,
Item [56], References Cited, U.S. PATENT DOCUMENTS, "3,451,700 A * 6/1969 Turpen …….292/218" should be -- 3,451,705 A * 6/1969 Turpen ……. 292/218 --.

Column 8,
Line 1, "tongue 10" should be -- tongue 110 --.

Signed and Sealed this

Twenty-third Day of August, 2005

JON W. DUDAS
*Director of the United States Patent and Trademark Office*